US007090203B2

(12) United States Patent
Goto

(10) Patent No.: US 7,090,203 B2
(45) Date of Patent: Aug. 15, 2006

(54) CARBURETOR FOR INTERNAL COMBUSTION ENGINE

(76) Inventor: Shinji Goto, 3-3-14, Ohmizo, Rokujo, Gifu-shi, Gifu-ken, 500-8357 (JP)

( * ) Notice: Subject to any disclaimer, the term of this patent is extended or adjusted under 35 U.S.C. 154(b) by 166 days.

(21) Appl. No.: 10/767,456

(22) Filed: Jan. 30, 2004

(65) Prior Publication Data

US 2005/0104234 A1 May 19, 2005

(30) Foreign Application Priority Data

Nov. 13, 2003 (JP) ..... 2003-384021

(51) Int. Cl.
*F02M 19/10* (2006.01)

(52) U.S. Cl. ..... 261/22; 261/40; 261/76; 261/78.1; 261/118; 261/DIG. 12; 261/DIG. 55

(58) Field of Classification Search ..... 261/22, 261/40, 76, 118, DIG. 12, DIG. 56, 78.1, 261/78.2, DIG. 55
See application file for complete search history.

(56) References Cited

U.S. PATENT DOCUMENTS

| | | | | | |
|---|---|---|---|---|---|
| 1,443,343 | A | * | 1/1923 | Chandler | 261/72.1 |
| 1,562,651 | A | * | 11/1925 | Mock | 261/72.1 |
| 1,631,716 | A | * | 6/1927 | Baverey | 261/41.5 |
| 1,977,721 | A | * | 10/1934 | Funderburk | 261/34.2 |
| 2,711,884 | A | * | 6/1955 | Zarnack | 261/44.7 |
| 3,539,157 | A | * | 11/1970 | Fort | 261/34.1 |
| 3,841,612 | A | * | 10/1974 | Freismuth et al. | 261/23.2 |
| 4,308,835 | A | * | 1/1982 | Abbey | 123/439 |
| 4,387,685 | A | * | 6/1983 | Abbey | 123/439 |
| 4,430,251 | A | * | 2/1984 | Patterson et al. | 366/349 |
| 4,673,536 | A | * | 6/1987 | Morris | 261/78.1 |
| 5,863,470 | A | * | 1/1999 | Grant | 261/23.2 |
| 6,120,007 | A | * | 9/2000 | Grant | 261/23.2 |
| 6,851,663 | B1 | * | 2/2005 | Satterfield | 261/23.2 |
| 2005/0104234 | A1 | * | 5/2005 | Goto | 261/40 |

FOREIGN PATENT DOCUMENTS

| | | | | |
|---|---|---|---|---|
| JP | 63-9665 | * | 1/1988 | 261/DIG. 12 |
| JP | 5-118242 | | 5/1993 | |
| JP | 10-196458 | | 7/1998 | |

* cited by examiner

*Primary Examiner*—Richard L. Chiesa
(74) *Attorney, Agent, or Firm*—Westerman, Hattori, Daniels & Adrian, LLP.

(57) ABSTRACT

A carburetor for an internal combustion engine has an intake pipe having a throttle valve plate therein. An annular venturi tube is disposed upstream or downstream of the throttle valve plate inside the intake pipe. The annular venturi tube is located at a predetermined interval with the throttle valve plate. The annular venturi tube has a fine continuous annular slit or four or more annularly arranged fuel discharging pores so as to atomize the fuel thereat. Atomization is always carried out near a position where a fastest air moves so as to improve the atomization and a uniform air-fuel mixture, thereby improving an output, fuel consumption and exhaust gas emission of the internal combustion engine.

10 Claims, 21 Drawing Sheets

PRIOR ART FIG. 42
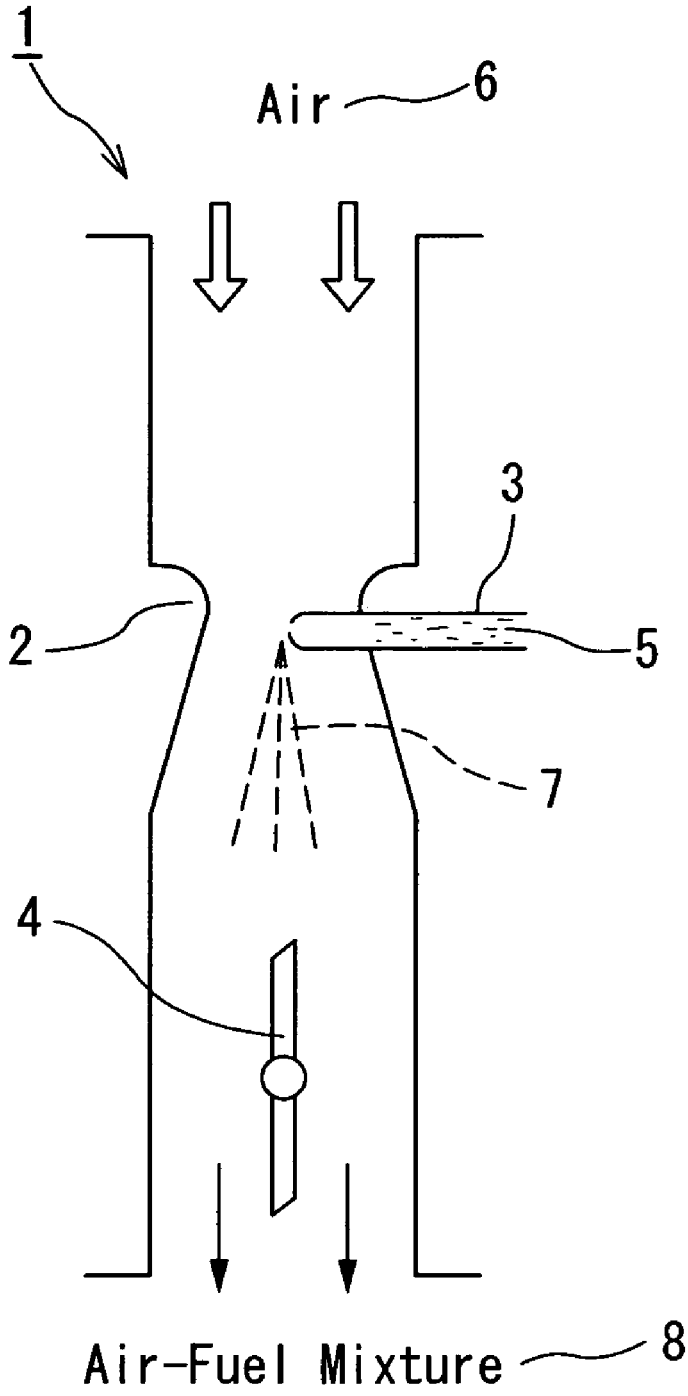

CARBURETOR FOR INTERNAL COMBUSTION ENGINE

BACKGROUND OF THE INVENTION

1. Field of the Invention

This invention relates to a carburetor for an internal combustion engine that generates air-fuel mixture for the internal combustion engine, and is particularly applicable to the internal combustion engine for an automobile, a motorcycle, a scooter, a snowmobile, a personal watercraft, etc.

2. Description of the Related Art

FIG. 42 shows structure of main parts of conventional carburetors for internal combustion engines. FIG. 42 is an explanatory drawing showing a structure in which a venturi portion is disposed upstream of a throttle valve.

In FIG. 42, a carburetor 1 of an internal combustion engine has a venturi portion 2. The venturi portion 2 is structured so as to squeeze an air breathed in the carburetor 1 and to increase a speed of the air. A fuel 5 of a liquid state is supplied to the carburetor 1. A fuel discharge nozzle 3 vaporizes the fuel 5 while the air 6 is breathed in the carburetor 1 so that the fuel is vaporized and discharged from the nozzle 3. Thus, a vaporized air-fuel mixture 8 of the fuel 7 and the air 6 is supplied.

In the fuel discharge nozzle 3 of the carburetor 1, the liquid fuel 5 is drawn out by the air accelerated at the venturi portion 2 due to a negative pressure generated by a piston action of the internal combustion engine. Then, the fuel is discharged from a leading end of the nozzle 3 as a vaporized fuel 7 in the form of a fine mist. A throttle valve 4 is disposed upstream or downstream of the venturi portion 2. The throttle valve 4 regulates a flow rate of the air 6 so as to control an output of the internal combustion engine.

That is, the air 6 induced into the carburetor 1 increases the flow velocity at the venturi portion 2 so as to atom the liquid fuel 5 from the fuel discharge nozzle 3. Consequently, the mist fuel 7 is mixed with the air 6 and discharged toward a downstream side of the venturi portion 2 in the form of air-fuel mixture 8.

As a result, if an opening of the throttle valve 4 is smaller, the velocity of the air flowing the venturi portion 2 becomes lower. Then, the fuel 7 discharged from the nozzle 3 becomes hard to be atomized, thereby possibly deteriorating an output and a fuel consumption of the internal combustion engine as well as an exhaust gas emission. Thus, it is important to atomize the fuel in order to improve the output and the fuel consumption of the internal combustion engine as well as the exhaust gas emission.

As a conventional art improving atomization of a discharged fuel of a fuel supplying device for an internal combustion engine, there are various techniques proposed. One example heats and vaporizes the fuel by a hot water or a PTC heater or the like. Another example atomizes the fuel by a pressurized air. Still another example atomizes the fuel by an ultrasonic vibration.

Among them, Japanese Laid Open Patent Publication No. 5-118252 and No. 10-196458 are known as conventional arts related to an improvement of atomization of a fuel in a carburetor system except a fuel injection system. No. 5-118252 shows a carburetor and No. 10-196458 shows a heating device for a carburetor.

In the Publication No. 5-118252, a straightening plate is provided from a position of a throttle valve of a manifold part toward a mixture discharge opening The plate serves to partition the manifold part into a needle valve hole side and a throttle valve hole side in a diameter direction. It prevents an air-fuel mixture from becoming turbulent, increases a fuel density of the mixture and provides a fixed flow of the mixture. However, this system cannot facilitate atomization sufficiently.

In the Publication No. 10-196458, the heating device for the carburetor has a hot water supplying conduit for supplying hot water to the carburetor and a hot water discharging conduit for discharging the hot water after heating the carburetor. The conduits are connected to the carburetor by a joint. A water receiving part is provided on an outer wall part diagonally ahead or diagonally behind a carburetor main body so as to correspond with an end position of a throttle valve in an approximately idling opened timing while making an opening direction approximately parallel to a valve shaft of the throttle valve. A carburetor side connecting port of the joint is liquid tightly inserted into an opening part of the water receiving part. Either the hot water supplying conduit or the hot water discharging conduit is connected to respective two piping side connecting ports of the joint A partitioning member is provided on the carburetor side connecting port of the joint. The partitioning member sections the inside of the carburetor side connecting port into a chamber communicated with the hot water supplying conduit and a chamber communicated with the hot water discharging conduit.

However, according to the above system, new and expensive parts need be added for better atomization of the fuel so as to improve the output and the fuel consumption of the internal combustion engine as well as the exhaust gas emission. Moreover, the structure becomes complicated. Thus, it has disadvantages in terms of costs. On the other hand, a variety of improvements are proposed for the fuel injection device of the internal combustion engine. However, such improvements could not be adopted in the carburetor that is generally cheaper than the fuel injection device.

As described above, it has been difficult to improve atomization of the fuel with a simple structure and improve maximum output and fuel consumption as well as exhaust gas emission in the internal combustion engine.

In the carburetor 1 for the internal combustion engine, there have been proposed various techniques for better atomization of the fuel in order to improve the output and fuel consumption and the exhaust gas emission in the internal combustion engine. However, the aforementioned carburetor 1 cannot atomize the fuel sufficiently or needs additionally the expensive parts to improve the atomization.

On the other hand, in each of opening angles of the throttle valve 4, the air generated from the leading end of the throttle valve 4 is accelerated. When the accelerated air impinges on the leading end of the fuel discharge nozzle at the venturi portion 2, the fuel becomes atomized. However, a position of the accelerated air changes according to the opening angles of the throttle valve 4 in the conventional carburetor 1. Thus, there has been a problem that, if the air accelerated by the throttle valve 4 deviates from the leading end position of the fuel discharge nozzle 3, the fuel is hard to be atomized.

BRIEF SUMMARY OF THE INVENTION

An object of the present invention is to provide a carburetor that can realize better atomization of a fuel in every opening angles of a throttle valve with a simple structure so as to improve output and fuel consumption and exhaust gas emission of an internal combustion engine.

According to a first aspect of the invention, there is provided a carburetor for an internal combustion engine, comprising: an intake pipe having an inner wall the intake pipe supplying a fuel and an air for the internal combustion engine; a throttle valve disposed inside the intake pipe; and an annular venturi tube disposed at an upstream side or a downstream side of the throttle valve inside the intake pipe, the annular venturi tube being made of an annular body defining an inside air passage and an outside air passage inside an inner wall of the intake pipe, the annular body having a fuel discharging portion formed at an inner peripheral side thereof so to continuously atomize the fuel.

In a carburetor for an internal combustion engine according to the first aspect, the fuel discharging portion may have a fine annular slit formed on the inner peripheral side of the annular body of the venturi tube.

In a carburetor for an internal combustion engine according to the first aspect, the fuel discharging portion may have four or more pores formed on the inner peripheral side of the annular body of the venturi tube.

In a carburetor for an internal combustion engine according to the first aspect, the annular body of the venturi tube may be made of a circular annular body.

In a carburetor for an internal combustion engine according to the first aspect, the annular body of the venturi tube may be made of an elliptical or oval annular body.

In a carburetor for an internal combustion engine according to the first aspect, an area ratio of the inside air passage and the outside air passage of the annular venturi tube inside the intake pipe may be set within a range of 5±2 to 5±2.

In a carburetor for an internal combustion engine according to the first aspect, the fuel may be supplied to annular venturi tube from a plurality of points at a side of the intake pipe.

According to a second aspect of the invention, there is provided a carburetor for an internal combustion engine, comprising: an intake pipe having an inner wall the intake pipe supplying a fuel and an air for the internal combustion engine; a throttle valve disposed inside the intake pipe; and an annular venturi tube disposed at an upstream side or a downstream side of the throttle valve inside the intake pipe, the annular venturi tube being made of an annular body defining an inside air passage and an outside air passage inside an inner wall of the intake pipe, the annular body having a fuel discharging portion formed at an inner peripheral side thereof so to atomize the fuel by an air flow.

In a carburetor for an internal combustion engine according to the second aspect, the fuel discharging portion has a fine annular slit formed on the inner peripheral side of the annular body of the venturi tube.

In a carburetor for an internal combustion engine according to the second aspect, the fuel discharging portion may have four or more pores formed on the inner peripheral side of the annular body of the venturi tube.

In a carburetor for an internal combustion engine according to the second aspect, the fuel discharging portion may have a fine annular slit formed on the inner peripheral side of the annular body of the venturi tube, the annular venturi tube having a plurality of pores formed inside thereof so as to guide the fuel to the fine annular slit.

In a carburetor for an internal combustion engine according to the second aspect, the annular body of the venturi tube may be made of a circular annular body.

In a carburetor for an internal combustion engine according to the second aspect, the annular body of the venturi tube may be made of an elliptical or oval annular body.

In a carburetor for an internal combustion engine according to the second aspect, an area ratio of the inside air passage to the outside air passage of the annular venturi tube divided inside the intake pipe may be set within a range of 55±20%.

In a carburetor for an internal combustion engine according to the second aspect, the fuel may be supplied to annular venturi tube from a plurality at points of a side of the intake pipe.

In a carburetor for an internal combustion engine according to the second aspect, the annular venturi tube may be located inside of the intake pipe so as to be shifted from a center of the intake pipe toward the inner wall of the intake pipe.

In a carburetor for an internal combustion engine according to the second aspect the annular body of the venturi tube may have an upstream side and a downstream side, while the upstream side having an inner diameter sharply decreased and the downstream side having an inner diameter gradually increased compared with a diameter change of the upstream side.

A carburetor for an internal combustion engine according to the second aspect further comprising an annular center venturi tube disposed at an inside of an inner wall of the annular venturi tube, the annular center venturi tube defining an inside air passage and an outside air passage inside the annular venturi tube, the annular center venturi tube having an annular body formed into a length that extends a length of the annular venturi tube in an air flow direction on both sides, the annular body of the annular center venturi tube having a fuel discharging portion formed at an inner peripheral side thereof so to atomize the fuel by an air flow.

In a carburetor for an internal combustion engine according to the second aspect, the fuel discharging portion of the annular center venturi tube may have a fine annular slit formed on the inner peripheral side of the annular body thereof.

In a carburetor for an internal combustion engine according to the second aspect, the fuel discharging portion of the annular center venturi tube may have four ore more pores formed on the inner peripheral side of the annular body thereof.

In a carburetor for an internal combustion engine according to the second aspect, the fuel discharging portion of the annular center venturi tube may have a fine annular slit formed on the inner peripheral side of the annular body thereof, the annular center venturi tube having a plurality of pores formed inside thereof so as to guide the fuel to the fine annular slit thereof.

In a carburetor for an internal combustion engine according to the second aspect, the annular body of the annular center venturi tube may be made of a circular annular body.

In a carburetor for an internal combustion engine according to the second aspect, an area ratio of the inside air passage to the outside air passage of the annular center venturi tube divided inside the annular venturi tube may be set within a range of 25±20%.

In a carburetor for an internal combustion engine according to the second aspect, the fuel may be supplied to annular venturi tube from one or more points at a side of the intake pipe.

In a carburetor for an internal combustion engine according to the second aspect, the annular center venturi tube may be located inside of the intake pipe so as to be shifted from a center of the intake pipe toward the inner wall of the intake pipe in accordance with a shift in location of the annular venturi tube.

In a carburetor for an internal combustion engine according to the second aspect, the annular body of the annular center venturi tube may have an upstream side and a downstream side, while the upstream side having an inner diameter sharply decreased and the downstream side having an inner diameter gradually increased compared with a diameter change of the upstream side.

In a carburetor for an internal combustion engine according to the second aspect, the annular body of the annular center venturi tube may have an upstream side and a downstream side, while the upstream side having an outer diameter sharply increased and the downstream side having an outer diameter gradually decreased compared with a diameter change of the upstream side in relation to the fuel discharging portion of the annular venturi tube.

Further objects and advantages of the invention will be apparent from the following description, reference being had to the accompanying drawings, wherein preferred embodiments of the invention are clearly shown.

BRIEF DESCRIPTION OF THE SEVERAL VIEWS OF THE DRAWINGS

FIG. 42 is an explanatory drawing showing a structure in which a venturi portion is disposed upstream of a throttle valve in a conventional carburetor.

DETAILED DESCRIPTION OF THE INVENTION

Figure 1:
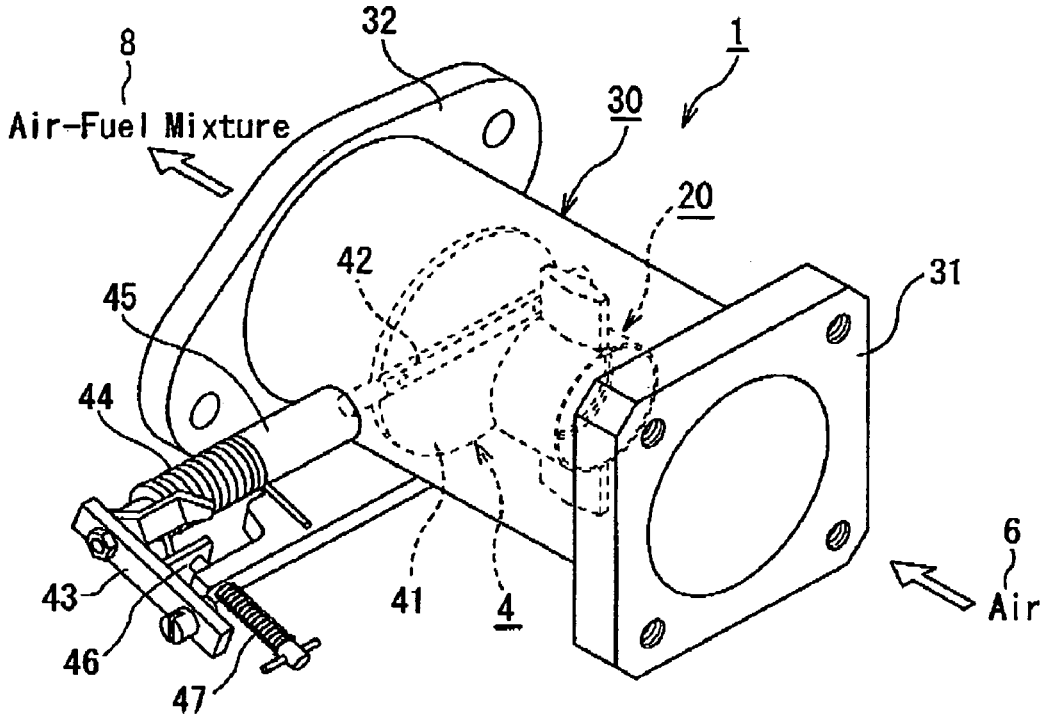
FIG. 1 is a perspective view of an overall structure of a carburetor for an internal combustion engine including an annular venturi tube and a throttle valve according to a first embodiment of the invention.

Several embodiments of the invention are described hereunder referring to the attached drawings. The same reference character is used to show the same element throughout the several embodiments.

FIRST EMBODIMENT

Figure 2:
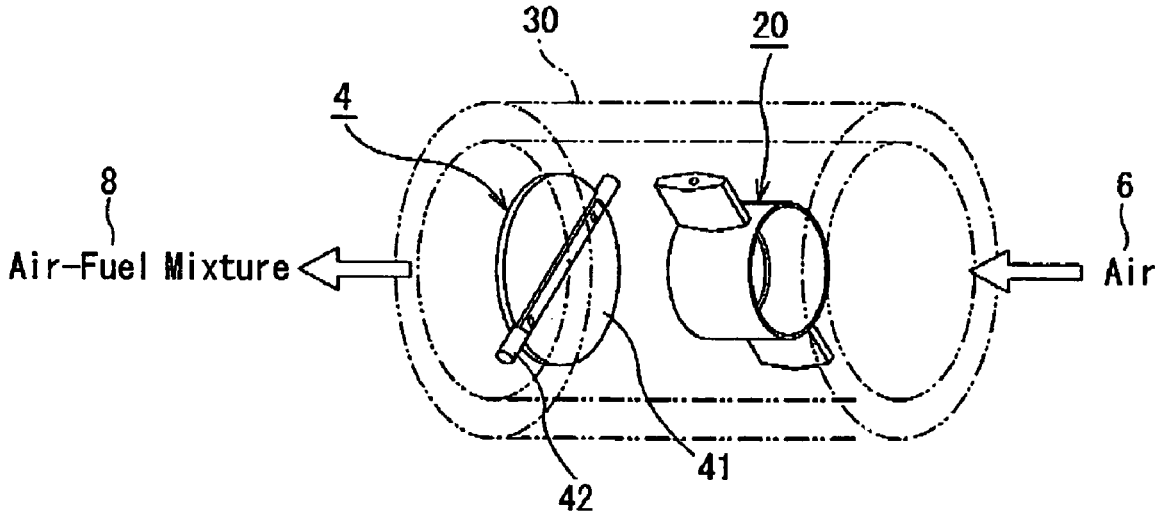
FIG. 2 is a perspective view of a positional relationship between the annular venturi tube and the throttle valve of FIG. 1.
Figure 3:
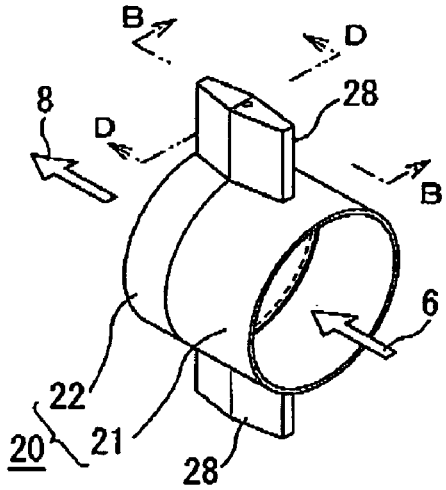
FIG. 3 is a perspective view of the annular venturi tube of FIG. 2.
Figure 4:
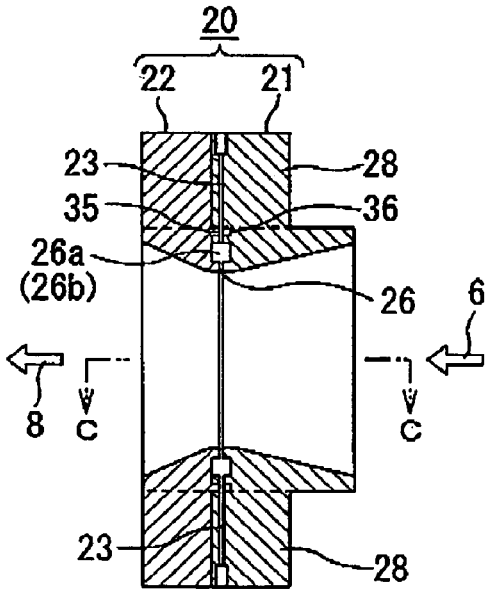
FIG. 4 is a cross-sectional view taken along the line B—B of FIG. 3.
Figure 5:
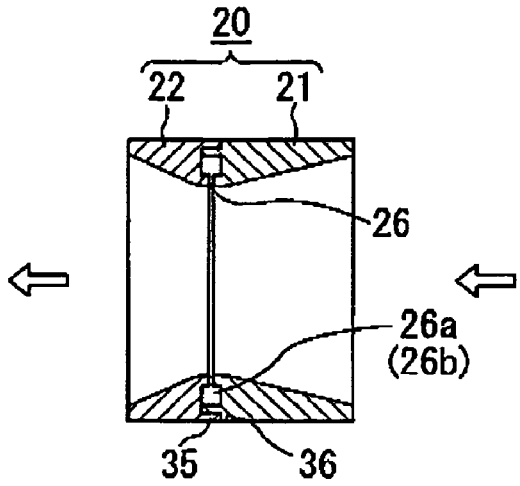
FIG. 5 is a cross-sectional view taken along the line C—C of FIG. 4.
Figure 6:
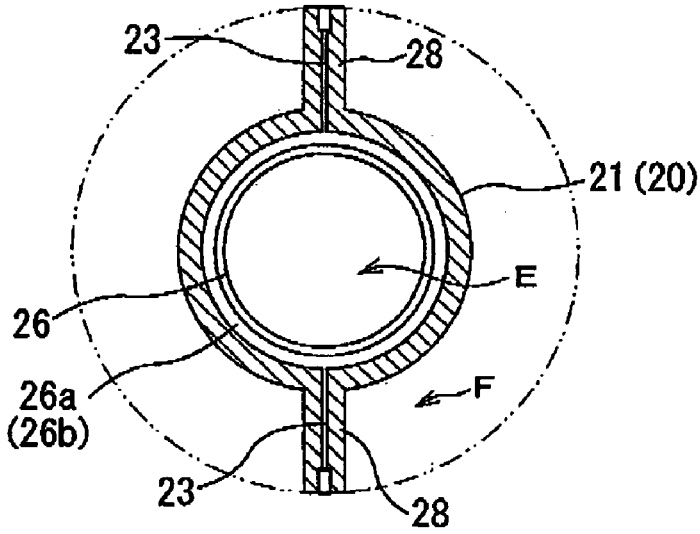
FIG. 6 is a cross-sectional view taken along the line D—D of FIG. 3.
Figure 7:
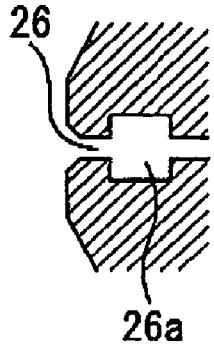
FIG. 7 is a view showing an example of a specific cross-section of a main part of a fuel discharge portion of the annular venturi tube of FIG. 3.
Figure 8:
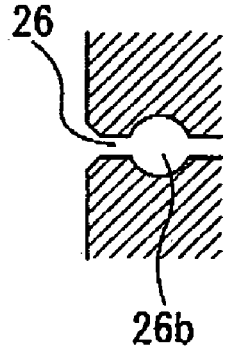
FIG. 8 is a view showing modified example of a specific cross-section of a main part of a fuel discharge portion of the annular venturi tube of FIG. 3.
Figure 9:
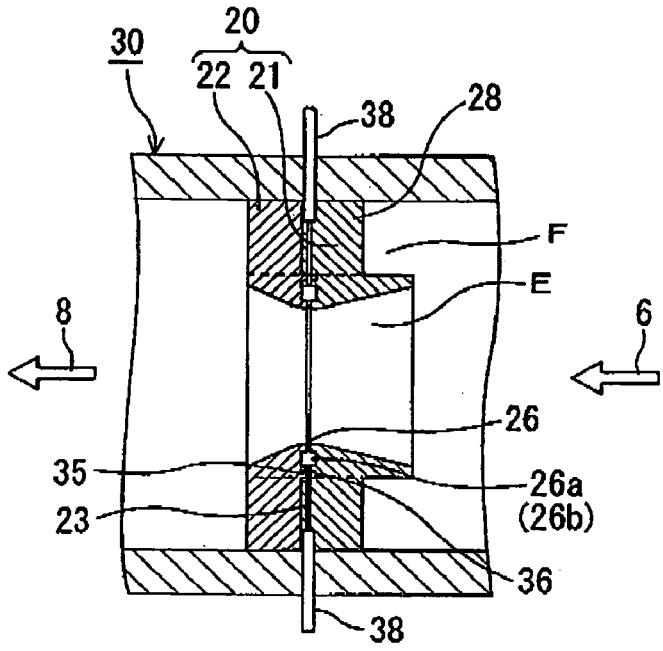
FIG. 9 is a cross-sectional view showing an assembled state of the annular venturi tube of FIG. 3.
Figure 10:
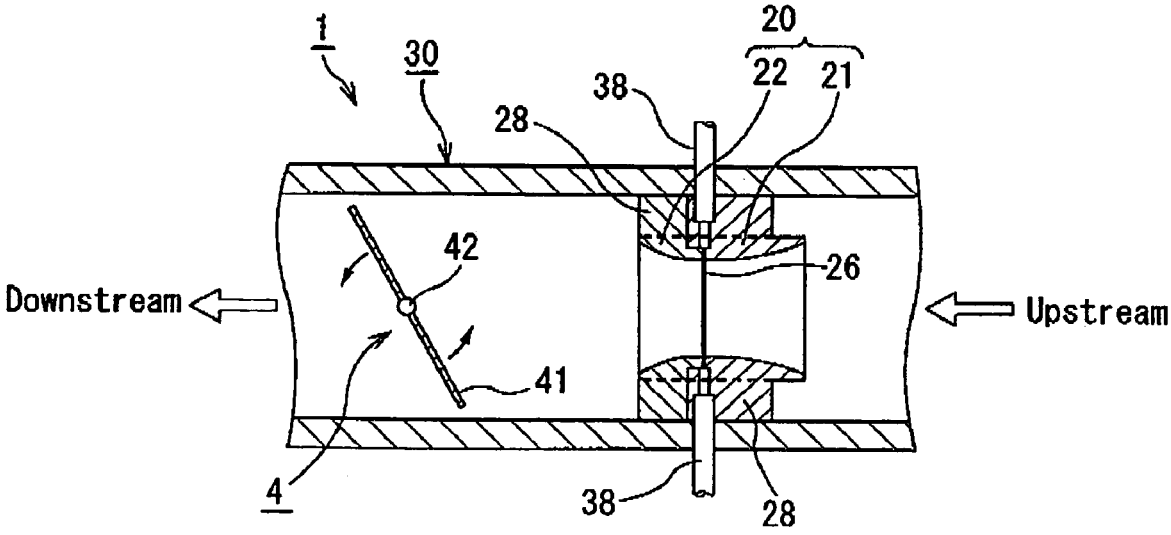
FIG. 10 is a cross-sectional view of the carburetor for the internal combustion engine according to the first embodiment of the invention, while showing a positional relationship between the throttle valve and the annular venturi tube.
Figure 11:
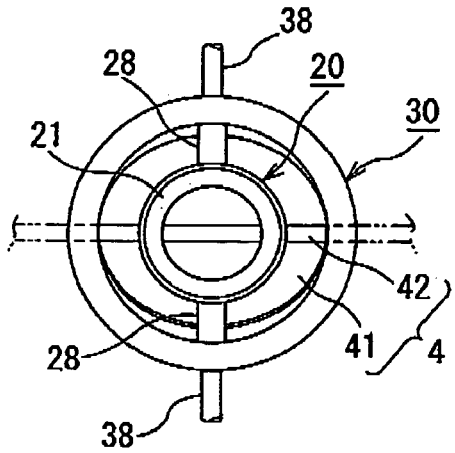
FIG. 11 is a side view of the carburetor of FIG. 10 seen from a right side.

FIG. 1 is a perspective view of an overall structure of a carburetor for an internal combustion engine including an annular venturi tube and a throttle valve according to a first embodiment of the invention. FIG. 2 is a perspective view of a positional relationship between the annular venturi tube and the throttle valve of FIG. 1. FIG. 3 is a perspective view of the annular venturi tube of FIG. 2. FIG. 4 is a cross-sectional view taken along the line B—B of FIG. 3. FIG. 5 is a cross-sectional view taken along the line C—C of FIG. 4. FIG. 6 is a cross-sectional view taken along the line D—D of FIG. 3. FIG. 7 is a view showing an example of a specific cross-section of a main part of a fuel discharge portion of the annular venturi tube of FIG. 3. FIG. 8 is a view showing modified example of a specific cross-section of a main part of a fuel discharge portion of the annular venturi tube of FIG. 3. FIG. 9 is a cross-sectional view showing an assembled state of the annular venturi tube of FIG. 3. FIG. 10 is a cross-sectional view of the carburetor for the internal combustion engine according to the first embodiment of the invention, while showing a positional relationship between the throttle valve and the annular venturi tube. FIG. 11 is a side view of the carburetor of FIG. 10 seen from a right side.

Referring to FIG. 1 to FIG. 11, a carburetor 1 for an internal combustion engine has a throttle valve 4 and an annular venturi tube 20. The throttle valve 4 constitutes a part of the carburetor 1. The throttle valve 4 is mainly composed of a throttle valve plate 41 and a valve shaft 42. The throttle valve plate 41 is fixed to the valve shaft 42 by screws or the like. As described later, the annular venturi tube 20 is used to atomize a fuel supplied to the internal combustion engine not shown. An intake pipe 30 has a pipe shape and permits an intake air to pass therethrough. The intake pipe 30 has a connection flange 31 and a connection flange 32. The connection flange 31 is connected to an air cleaner not shown that cleans the intake air. The connection flange 32 is connected to an intake manifold of the internal combustion engine. The throttle valve 4 and the annular venturi tube 20 are disposed at a prescribed interval in the intake pipe 30.

A valve shaft 45 is arranged on the throttle valve 4 so as to be rotated integrally with the valve shaft 42. A spring 44 is provided on the valve shaft 45 so as to urge the throttle valve 4 to return to a closed state. A full-closing stopper 46 is secured to the valve shaft 45 via a link mechanism 43 and determines a full-closing position of the throttle valve 4. An adjusting screw 47 is disposed at a side of the intake pipe 30 so as to adjust the full-closing position of the throttle valve 4 via the full-closing stopper 46. A not-shown throttle wire is connected to the link mechanism 43. The throttle valve 4 is controlled by an accelerator pedal or the like, which is operated by a driver, to an opening side through the throttle wire and the link mechanism 43 against an urging force of the spring 44.

The annular venturi tube 20 is disposed upstream of the throttle valve 4 in the intake pipe 30 at such an interval as an air flow velocity changed by the throttle valve plate 41 is not damped too much. The annular venturi tube 20 has an upstream annular venturi portion 21 and a downstream annular venturi portion 22 that have a circular cross-section and increase the air flow velocity. The annular venturi tube 20 further has two venturi supporting pillars 28 that form fuel supply route 23. The annular venturi tube 20 is fixed in the intake pipe 30 by press fitting or the like. The downstream annular venturi portion 22 has a fitting protrusion. The upstream annular venturi portion 21 has a fitting dent 36 in which the fitting protrusion 35 of the downstream annular venturi portion 22 is fitted. The upstream and the downstream venturi portions 21 and 22 are coupled with each other in one body by putting the fitting protrusion 35 into the fitting dent 36. The annular venturi tube 20 has a fuel discharging portion 26 that is chamfered or shaped as shown in FIG. 4, for example. The fuel discharging portion 26 has an fine annular slit having a cross-section that continues to an opening end and that is about 0.05 to 0.2 mm on a side. The slit is connected to a fuel route **26*a* of a square cross-section or a fuel route 26*b* of a round cross-section. Each of the two venturi supporting pillars 28 has the fuel supplying route 23 for feeding the fuel to the fuel discharging portion 26. The intake pipe 30 is connected with a fuel supplying pipe 38 for supplying the fuel corresponding to the fuel supplying route 23 of the annular venturi tube 20. The fuel is supplied from a not shown fuel tank via a diaphragm fuel pump or the like to the fuel supplying routes 23. Then, the fuel is fed to the fuel route 26*a* or the fuel route 26*b* from the supplying route 23. Thereafter, the fuel is atomized or vaporized and injected from the fuel discharging portion 26** composed of the annular slit.

An operation of the carburetor 1 for the internal combustion engine is described hereunder.

If a not-shown accelerator wire is operated by an action on an accelerator of a driver, an opening angle of the throttle valve plate 41 is adjusted in the intake pipe 30. Then, the flow rate of the air 6 supplied from the air cleaner is regulated in accordance with the opening angle of the throttle valve plate 41. Then, the supplied air 6 is introduced into the annular venturi tube 20 while increasing its flow velocity at the upstream venturi portion 21.

On the other hand, the fuel is supplied from the fuel tank via the diaphragm fuel pump or the like and introduced from the fuel supplying pipe 38 provided on the intake pipe 30. Then, the fuel passes the fuel supplying route 23 and the fuel route 26*a* or the fuel route 26*b*, thereby being atomized and discharged from the fuel discharging portion 26. At this time, the fuel is continuously discharged from the fuel discharging portion 26, which is a fastest portion of the air flow decided main by the opening angle of the throttle valve 4, toward a downstream side in the form of a fine mist.

As described above, according to the first embodiment of the carburetor 1 for the internal combustion engine, the intake pipe 30 supplies the fuel and the air 6 to the internal combustion engine, while the annular venturi tube 20 is disposed upstream or downstream of the throttle valve 4 in the intake pipe 30. The annular venturi tube 20 has such an annular shape as to form an inner and an outer air passages inside of an inner wall surface of the intake pipe 30. The annular venturi tube 20 has the fuel discharging portion 26 formed at an inner peripheral side so as to continuously atomize the fuel by the air flow.

That is, the fastest part of the air flow exists at the fuel discharging portion 26 composed of the fine annular slit disposed on the annular venturi tube 20. Consequently, the fuel discharged from the fuel discharging portion 26 is atomized well. At this time, if observing an air flow velocity distribution passing the annular venturi tube 20 in the intake pipe 30, the air flow near a leading end of the throttle valve plate 41 becomes the fastest. The fastest position varies in the air flow velocity distribution in accordance with the opening angle of the throttle valve 4.

The fastest portion of the air flow velocity always exists at the fuel discharging portion 26 composed of the fine annular slit or the slit portion regardless of the opening angle of the throttle valve plate 41. Therefore, the fuel is discharged to be atomized mainly from the fastest portion of the air flow velocity at the fuel discharging portion 26. Consequently, atomization of the fuel is expedited in the intake pipe 30, so that very uniform air-fuel mixture is supplied to the internal combustion engine. As a result, the output and the fuel consumption as well as the exhaust gas emission of the internal combustion engine are improved.

The annular venturi tube 20 composed of the upstream and the downstream venturi portions 21 and 22 can be manufactured comparatively easily, e.g. by die-casting aluminum or the like. Thus, production costs can be kept low.

The fuel is supplied from the fuel kink via the diaphragm fuel pump or the like and introduced from the fuel supplying pipe 38 provided on the intake pipe 30. Then, the fuel passes the fuel supplying route 23 and the fuel route 26*a* or the fuel route 26*b* , thereby being atomized at the fuel discharging portion 26 composed of the fine annular slit. At this time, the fuel is continuously discharged from the fuel discharging portion 26, which is a fastest portion of the air flow decided by the opening angle of the throttle valve 4, toward a downstream side in the form of a fine mist of about 200 to 500 μm.

The atomized fuel discharged from the fuel discharging portion 26 is mixed with the air very uniformly in the intake pipe 30. Consequently, the atomized fuel never sticks or flows on an intake manifold and a wall surface of a combustion chamber of the internal combustion engine, thereby improving combustion efficiency. As a result, it is possible to reduce unburned hydrocarbon (HC) and half-burned carbon monoxide (CO), thereby improving the output, the fuel consumption and the exhaust gas emission of the internal combustion engine.

Particularly, the annular venturi tube 20 is composed of the upstream annular venturi portion 21 and the downstream annular venturi portion 22 so as to define an inner air passage E at the inside thereof, as shown in FIG. 6, and an outer air passage F at the outside thereof. Then, the annular venturi tube 20 is constituted such that an area ratio of the inner air passage E and the outer air passage F is five to five (5 to 5). According to experiments by the inventors, it was confirmed that the area ratio of the inner air passage E and the outer air passage F of the annular venturi tube 20 should be preferably within a range of 5±2 to 5±2.

If the area ratio of the inner air passage E and the outer air passage F of the annular venturi tube 20 is set within the range of 5±2 to 5±2, the fuel 7 vaporized at the fuel discharging portion 26 is diffused into the air 6 passing through the air passage E and the air 6 passing through the air passage F, respectively. That is, the fuel 7 that is atomized at a predetermined spreading angle from the fuel discharging portion 26 is diffused into the airs passing through the inside and the outside or the air passage E and the air passage F.

According to the experiments of the inventors, where the area ratio is outside the above range, the fuel 7 atomized at the fuel discharging portion 26 is attached to the intake pipe 30, in case the outside air passing through the outer air passage F of the annular venturi tube 20 is low in amount. Moreover, spread of the atomized fuel 7 is limited, in case the inside air passing through the inner air passage E of the annular venturi tube 20 is low in amount. However, if the area ratio of the inner air passage E and the outer air passage F of the annular venturi tube 20 is within the range of 5±2 to 5±2, the atomized fuel 7 discharged from the fuel discharging portion 26 is diffused at the downstream side. Then, the atomized fuel 7 is covered by the air flow passing through the air passage F. Therefore, the fuel is prevented from being attached on the wall surface of the intake pipe 30, thereby decreasing unburned or half-burned state. Accordingly, it is possible to improve the output, the fuel consumption and the exhaust gas emission of the internal combustion engine.

More preferably, the annular venturi tube 20 is constituted such that the inner air passage E defined by the annular venturi tube 20 composed of the upstream venturi portion 21 and the downstream venturi portion 22 has an area ratio of about 55% to the outer air passage F of the annular venturi tube 20. In this case, according to experiments by the inventors, it was confirmed that it is applicable if the area ratio of the inner air passage E and the outer air passage F of the annular venturi tube 20 is within a range of 85 to 75%, i.e. a range of 55±20%.

If the area ratio of the inner air passage E is set within the range of 35 to 75% relative to the outer air passage F of the venturi tube, the air 6 introduced into the intake pipe 30 and pausing through the throttle valve 4 is separated into the inner air passage E of the annular venturi tube 20 and the outer air passage F. Then, the air passing the inner air passage E of the annular venturi tube 20 is mixed with the fuel atomized at a predetermined spread angle from the fuel discharging portion 26. Thereafter the air-fuel mixture is diffused by the air passing the outer air passage F of the annular venturi tube 20, so that the mixing of the air and the atomized fuel is expedited.

According to the experiments of the inventors, it was confirmed that the fuel 7 atomized at the fuel discharging portion 26 was attached to inner wall surface of the intake pipe 30, in case the outside air passing through the outer air passage F of the annular venturi tube 20 was low in amount. To the contrary, it was confirmed that the spread of the atomized fuel 7 was limited, in case the inside air passing through the inner air passage E of the annular venturi tube 20 was low in amount.

In contrast, if the area ratio of the inner air passage E and the outer air passage F of the annular venturi tube 20 in the intake pipe 30 is within the rang of 55±20%, the mixing of the air and the atomized fuel 7 discharged from the fuel discharging portion 26 of the annular venturi tube 20 is well facilitated. That is, the air-fuel mixture is covered by the air flow passing through the air passage F. Thereby, it was confirmed that the fuel was free from being attached on the inner wall surface of the intake pipe 30. Consequently, unburned or half-burned state in the internal combustion engine is restrained. Accordingly, it is possible to improve the output, the fuel consumption and the exhaust gas emission of the internal combustion engine.

The fuel supplied from the fuel tank by the diaphragm fuel pump or the like is introduced from the fuel pipes as disposed on the intake pipe 30 into the fuel discharging portion 26 composed of the fine annular slit. At this time, the fuel discharging portion 26 is supplied with the fuel from plural points, e.g. from two fuel pipes 38 located at an upper and a lower sides.

Then, the fuel is introduced into the fine annular slit of the fuel discharging portion 26 at a pressure divided by two circuits of two points of the fuel pipes 38. Thereby, the fuel is uniformly supplied in a state of less difference in fluid resistance. Consequently, it is possible to make fueling condition essentially even at the fine annular slit of the fuel discharging portion 26. As a result, the fuel discharged from the fuel discharging portion 26 is atomized very uniformly.

The first embodiment is structured such that the fuel is supplied from the two points at an outer peripheral side of the intake pipe 30 to the fuel discharging portion 26 formed at an inner peripheral side of the annular venturi tube 20. However, the invention is not limited thereto. For example, the fuel may be supplied from plural points such as one or more points as long as it is possible to restrain variation or fluctuation of the fuelling condition at the fuel discharging portion 26 of the annular venturi tube 20 that is composed of the fine annular slit.

In the first embodiment, the fuel supplying routes 23 are formed in the two venturi supporting pillars 28 located upside and downside, respectively; Moreover, the venturi supporting pillars 28 are also used to mount the annular venturi tube 20 on the intake pipe 30. Consequently, it is possible to restrain well the variation of the fuelling condition at the fuel discharging portion 26 of the annular venturi tube 20 that is composed of the fine annular slit. In addition, the annular venturi tube 20 can be stably mounted on the intake pipe 30 by the venturi supporting pillars 28.

SECOND EMBODIMENT

Figure 12:
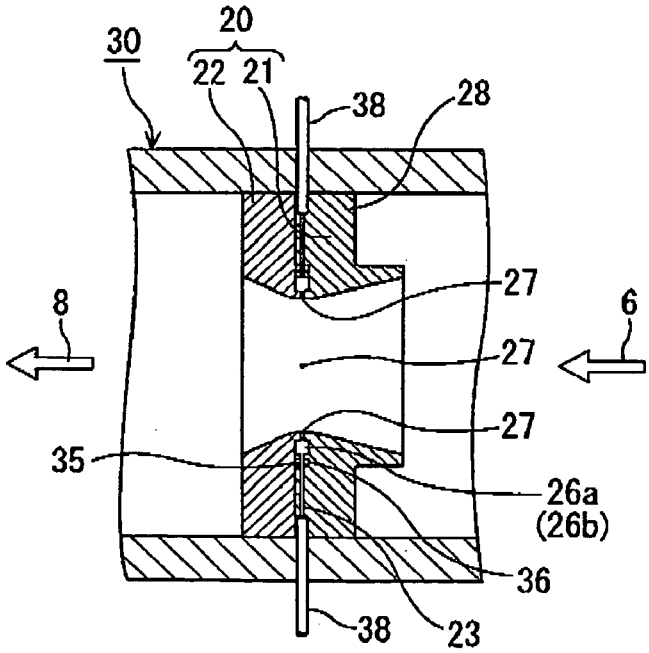
FIG. 12 is a cross-sectional view of an annular venturi tube of a carburetor for an internal combustion engine according to a second embodiment of the invention.
Figure 13:
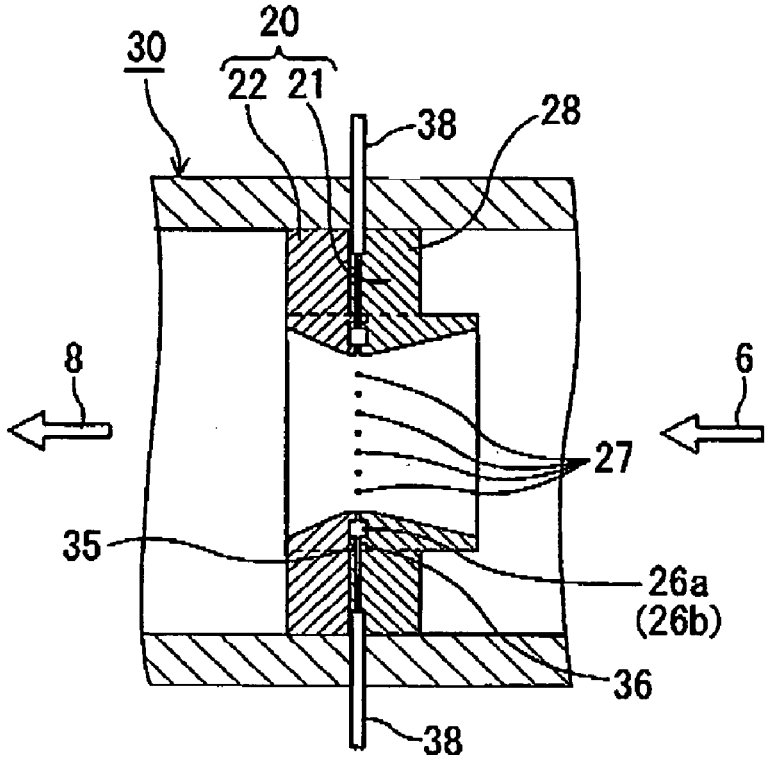
FIG. 13 is a cross-sectional view showing an modified example of an annular venturi tube of a carburetor for an internal combustion engine according to the second embodiment of the invention.

FIG. 12 is a cross-sectional view of an annular venturi tube of a carburetor for an internal combustion engine according to a second embodiment of the invention. FIG. 13 is a cross-sectional view showing a modified example of an annular venturi tube of a carburetor for an internal combustion engine according to the second embodiment of the invention.

Referring to FIG. 12, a plurality of fuel discharging small holes or pores 27 is formed on the veturi tube 20 for atomizing the fuel. That is, in the second embodiment, four fuel discharging pores 27 are formed along a circumference of the inner wall surface of the annular venturi tube 20 in place of the fine annular slit of the fuel discharging portion 26. In case of providing the four fuel discharging pores 27 in the second embodiment, a first pair of fuel discharging pores 27 is formed at such points as to be at right angles to the valve shaft 42 of the throttle valve 4 in a plane parallel to the valve shaft 42. Moreover, a second pair of fuel discharging pores 27 is formed at points rotated 90 degrees relative to the first pair of the fuel discharging pores 27. Namely, the four pores 27 are formed at angular intervals of 90 degrees with each other and aligned along the circumference of the inner wall surface of the annular venturi tube 20 at a location corresponding to the fuel discharging annular slit of the first embodiment. Still, in practicing the invention, it is more effective to provide a flat pair of fuel discharging pores 27 at such points as to be at right angles to the valve shaft in the plane parallel to the valve shaft 42 and a second pair of fuel discharging pores 27 and a third pair of fuel discharging pores 27 at points dividing an angle between the first pair of the pores 27 into three. In this case, six fuel discharging pores 27 are formed in total at equal or unequal angular intervals along the circumference of the inner wall surface of the annular venturi tube 20 so as to make angular pairs, respectively. Moreover, it is more preferable to provide fuel discharging pores 27 at each of points dividing the angle between the first pair of the pores 27 into four or more. That is, the fuel discharging pores 27 provided inside the intake pipe 30 are preferably provided in four or more in number. Practically, it is desirable to form six or more pores 27 in number or in multiplicity FIG. 13 illustrates such example. Specifically, the embodiment shown in FIG. 12 and FIG. 13 is different from the first embodiment in the fuel discharging pores 27 that are formed in multiplicity as fuel discharging portions for discharging the fuel toward an inner periphery of the annular venturi tube 20.

In the second embodiment, the fuel discharging portion 26 composed of the fine annular slit is not provided on the annular venturi tube 20. Instead, the plurality of the fuel discharging pores 27 is formed at the inner periphery of the annular venturi tube 20 so as to be disposed at fixed intervals in the parallel plane to the valve shaft 42 of the throttle valve 4. Each of the pores 27 has a diameter of about 0.5 to 1.5 mm. If the number of the fuel discharging pores 27 is small, the fuel cannot be always atomized at fast points of the air flow velocity depending on the opening angle of the throttle valve 4, in contrast with the first embodiment. Thus, there might be generated an area that is insufficient for facilitating atomization. To deal with such possibility, four or more fuel discharging pores 27 are formed in the second embodiment. Thus, the fuel discharged from each of the fuel discharging pores 27 can be atomized efficiently and squirted downstream with a considerable spread angle. Moreover, the fuel discharging pores 27 are disposed at essentially a center position of the intake pipe 30. Thus, the atomized fuel from the fuel discharging pore 27 is restrained from impinging on the inner wall surface of the intake pipe 30 and becoming liquid fuel. As a result, the second embodiment has the same advantageous effects as the first embodiment.

Specifically, if an accelerator wire is operated by an action on an accelerator of a driver, an opening angle of the throttle valve plate 41 of the throttle valve 4 is adjusted in the intake pipe 30. Then, the flow rate of the air 6 supplied from the air cleaner is regulated in accordance with the opening angle of the throttle valve plate 41. Then, the supplied air 6 is introduced into the annular venturi tube 20 while increasing its flow velocity thereat.

On the other hand, the fuel is supplied from the fuel tank via the diaphragm fuel pump or the like and introduced from the fuel supplying pipe 38 provided on the intake pipe 30. Then, the fuel passes the fuel supplying route 23 and the fuel route 26*a* or the fuel route 26*b* , thereby being atomized and discharged from the fuel discharging pores 27. At this time, the fuel is continuously discharged from the fuel discharging pores 27, which are formed on the inner periphery of the annular venturi tube 20 and which are fastest portions of the air flow decided mainly by the opening angle of the throttle valve 4, toward a downstream side in the form of a fine mist.

Accordingly, the fastest portions of the air flow velocity always exist at the fuel discharging pores 27 regardless of the opening angle of the throttle valve plate 41. Therefore, the fuel is discharged to be atomized mainly from the fastest portions of the air flow velocity. Consequently, atomization of the fuel is expedited in the intake pipe 30, so that very uniform air-fuel mixture is supplied to the internal combustion engine. As a result, the output and the fuel consumption as well as the exhaust gas emission of the internal combustion engine are improved. As described above, according to the second embodiment of the carburetor for the internal combustion engine, the fuel is uniformly supplied to the fuel discharging portion for atomizing the fuel. As a result the uniformly atomized fuel can be supplied, thereby improving the output, the fuel consumption and the exhaust gas emission of the internal combustion engine.

THIRD EMBODIMENT

Figure 14:
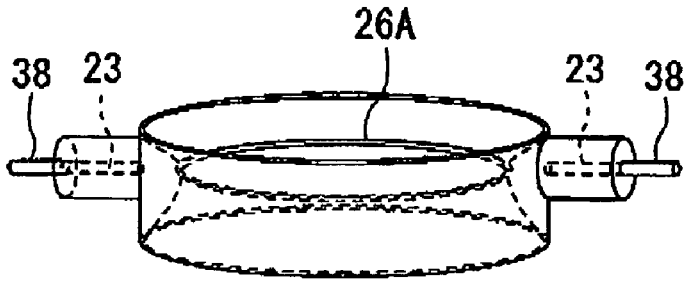
FIG. 14 is a perspective view showing an overall structure of an annular venturi tube of a carburetor for an internal combustion engine according to a third embodiment of the invention.
Figure 15:
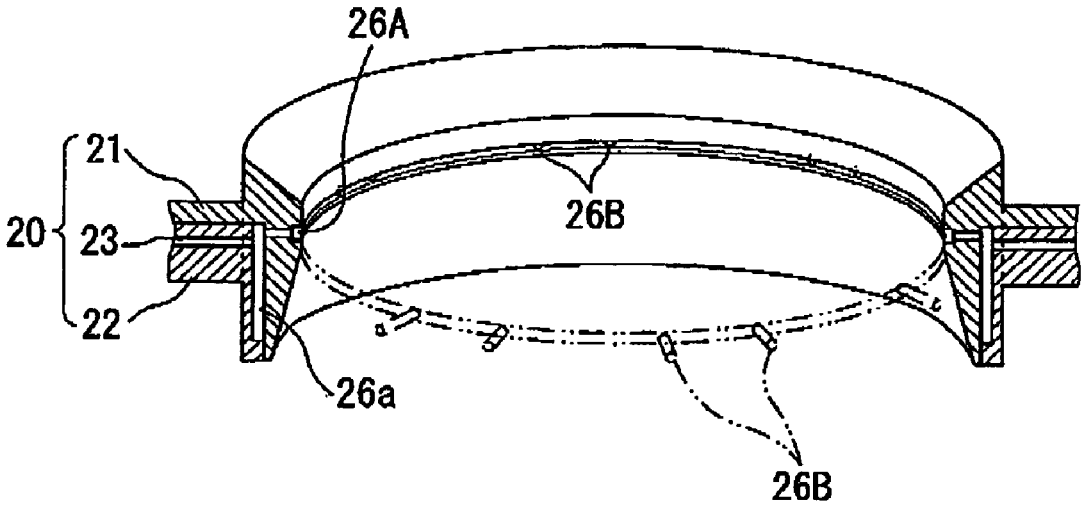
FIG. 15 is a perspective view cut along an imaginary centerline of FIG. 14 and showing a partial structure thereof

FIG. 14 is a perspective view showing an overall structure of an annular venturi tube of a carburetor for an internal combustion engine according to a third embodiment of the invention. FIG. 15 is a perspective view cut along an imaginary centerline of FIG. 14 and showing a partial structure thereof FIG. 16 is an enlarged partial cross-section of FIG. 15.

Figure 16:
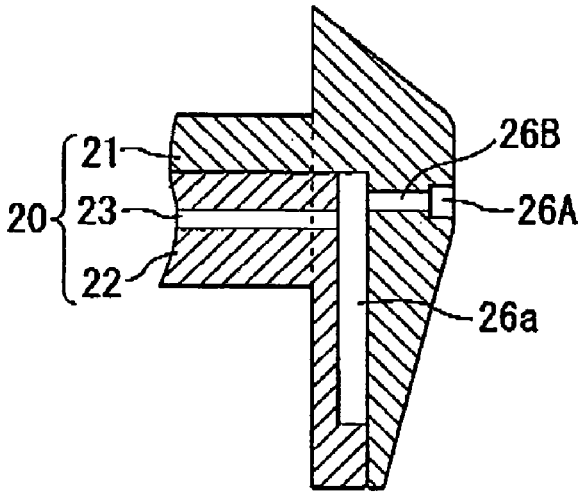
FIG. 16 is an enlarged partial cross-section of FIG. 15.

Referring to FIG. 14 to FIG. 16, the third embodiment of an annular venturi tube 20 has a fuel discharging portion 26A of a fine annular slit that opens toward an inner peripheral side. The fuel discharging portion 26A is connected to the fuel routes 26*a* of square cross-section via plural small holes or pores 26B. That is, the liquid fuel supplied to the fuel route 26*a* via the fuel supplying route 23 passes through the pores 26B so as to be fed to the fuel discharging portion 26A that is the annular slit.

In the third embodiment of the carburetor for the internal combustion engine, the fuel discharging portion 26A formed at the inner peripheral side of the annular venturi tube 20 atomizes successively the liquid fuel. Since the fuel is guided from the inside fuel route 26*a* to the fuel discharging portion 26A or the fine annular slit via the plural pores 26B, positions of the fuel discharging portion 26A to which the fuel should be guided are specified by the pores 26B. Then, it is unnecessary to guide the fuel to a pore 26B located at an unnecessary position in feeding the fuel to the fuel discharging portion 26A. Consequently, excessive fuel is never produced in the fine annular slit when the throttle valve 4 is closed.

Accordingly, it is possible to provide the annular venturi tube 20 having a good responsibility by combining the characteristic features of the above embodiments.

Moreover, in the third embodiment of the carburetor for the internal combustion engine, an annular body of the venturi tube 20 has an upstream side and a downstream side, as shown in FIG. 16. Specifically, in the upstream side, an inner diameter of the upstream annular venturi portion 21 is decreased sharply, while the inner diameter of the downstream annular venturi portion 22 is increase gradually in comparison with a change in the inner diameter of the upstream side. Thus, the flow velocity becomes substantial the highest at the fuel discharging portion 26A at the inner peripheral side of the venturi tube 22, so that the flow becomes tidy and ordered. Moreover, the flow velocity becomes lower as it overpasses the fuel discharging portion 26A, so that the fir flow is easy to be spread Thus, the air and the atomized fuel are mixed very well, so that the combustion characteristics can be improved.

FOURTH EMBODIMENT

Figure 17:
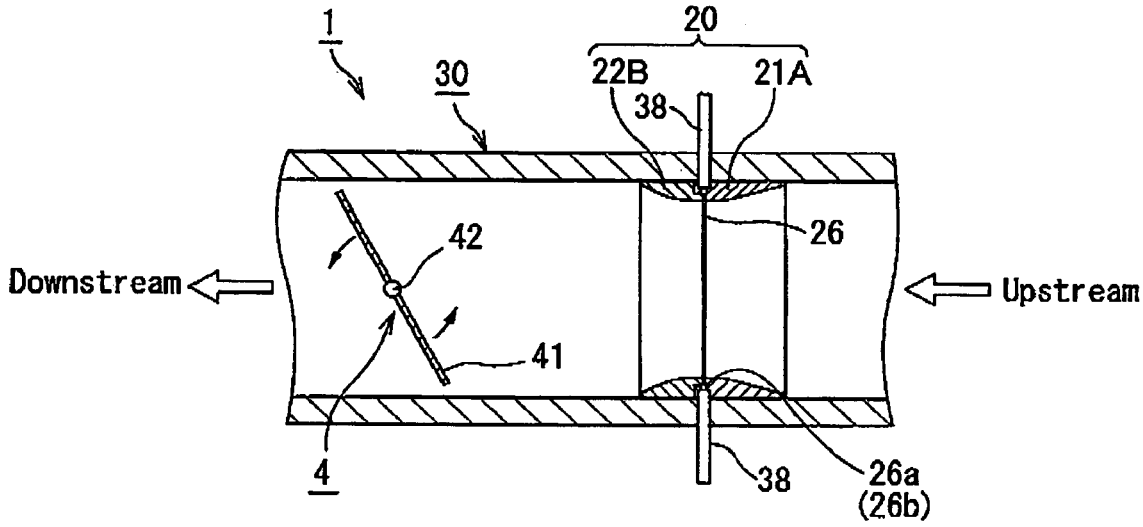
FIG. 17 is a cross-sectional view of a carburetor for an internal combustion engine according to a fourth embodiment of the invention, while showing a positional relationship between a throttle valve and an annular venturi tube.
Figure 18:
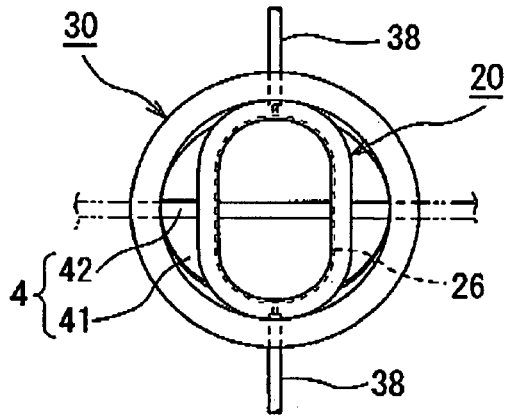
FIG. 18 is a side view of the carburetor of FIG. 17 seen from a right side.
Figure 19:
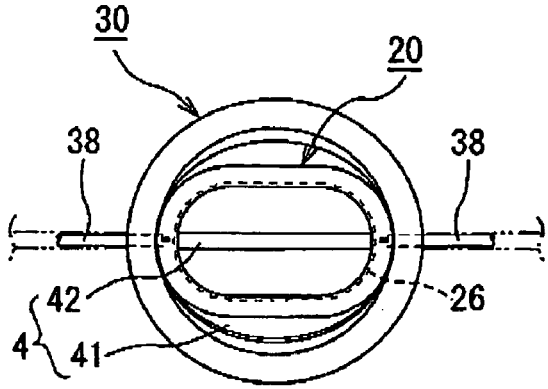
FIG. 19 is a side view showing a modified example of the carburetor for the internal combustion engine according to the fourth embodiment of the invention, while showing a view seen from a right side of a cross-section corresponding to FIG. 17.

FIG. 17 is a cross-sectional view of a carburetor for an internal combustion engine according to a fourth embodiment of the invention, while showing a positional relationship between a throttle valve and an annular venturi tube. FIG. 18 is a side view of the carburetor of FIG. 17 seen from a right side. FIG. 19 is a side view showing a modified example of the carburetor for the internal combustion engine according to the fourth embodiment of the invention, while showing a view seen from a right side of a cross-section corresponding to FIG. 17.

Referring to FIG. 17 to FIG. 19, an annular venturi tube 20 is shaped into an elliptical or oval tube as seen in a flow direction of the air, instead of the circular tube as described above. The annular venturi tube 20 has no venturi supporting pillars 28 but is secured directly to the intake pipe 30. Particularly, FIG. 18 illustrates an example in which the annular venturi tube 20 has an elliptic or oval shape having a longitudinal direction disposed at right angles to the valve shaft 42 of the throttle valve plate 41 in the parallel plane. FIG. 19 illustrates an example in which the annular venturi tube 20 has an elliptic or oval shape having a longitudinal direction disposed in parallel with the valve shaft 42 of the throttle valve plate 41 in the parallel plane.

As described above, the throttle valve 4 is disposed downstream of the intake pipe 30, while the annular venturi tube 20 composed of the upstream and downstream annular venturi portions 21 and 22 being disposed upstream of the intake pipe 30. They have a positional relationship with such an interval that the air generated at the throttle valve 4 and having fast velocity is not damped. Moreover, the flow velocity of the air introduced from the air cleaner is increased by the upstream annular venturi portion 21 of the venturi tube 20 having the elliptic or oval shape. Furthermore, the fuel discharging portion 26 composed of the fine annular slit is made by an upstream annular venturi portion 21A and a downstream annular venturi portion 22B. Then, the fuel is introduced from the intake pipe 30 via the fuel supplying pipe 38 and passes the fuel route 26*a* of square cross-section or the fuel route 26*b* of round cross-section of the downstream venturi portion 22B. Thereafter, the fuel is discharged and atomized by the fuel discharging portion 26 composed of the annular slit.

In FIG. 18, the elliptic or oval annular venturi tube 20 is arranged such that the longitudinal direction is at right angles to the valve shaft 42 of the throttle valve plate 41 in the parallel plane. Thus, the flow rate of the air introduced from the air cleaner is regulated in accordance with the opening angle of the throttle valve plate 41 arranged in the intake pipe 30. Thereby, the flow velocity of the air is increased at the upstream annular venturi portion 21A inside the annular venturi tube 20.

On the other hand, the fuel is fed from fuel tank via the fuel supplying pipe 38 mounted on the intake pipe 30. Such fuel is discharged and atomized from the fuel discharging portion 26 composed of the fine elliptical or oval annular slit. At this time, the fuel is discharged continuously to the downstream side in the form of fine mist mainly at the fastest portion of the flow velocity of the air that is decided by the opening angle of the throttle valve 4.

An air passage is formed between the inner wall surface of the intake pipe 30 and a minor as side of the elliptic or oval annular venturi tube 20 shown in FIG. 18. Namely, in FIG. 18, since the elliptic or oval annular venturi tube 20 has the longitudinal direction perpendicular to the valve shaft 42 in the parallel plane, so that the fastest portion of the air flow exists at the fuel discharging portion 26 composed of the continuous fine elliptic or oval slit. Thus, the fuel discharged from the fuel discharging portion 26 is atomized well.

On the other hand, as shown in FIG. 19, the longitudinal direction of the elliptic or oval annular venturi tube 20 corresponds to an axial direction of the valve shaft 42 of the throttle valve plate 41 in the parallel plane. In this case, it is preferable to set an interval between the throttle valve 4 and the annular venturi tube 20 such that the rapid velocity of the air flow generated at the throttle valve plate 41 is not damped, with respect to the fastest portion of the air flow generated at the leading end of the throttle valve plate 41. If set so, the air is diffused, so that the atomization of the fuel can be improved in the same way as the case in which the longitudinal direction is disposed at right angles to the valve shaft 42 in the parallel plane. Thereby, the atomization of the fuel is facilitated in the intake pipe 30, so that very uniform air-fuel mixture is supplied to the internal combustion engine. As a result, it is possible to improve the output, fuel consumption and exhaust gas emission of the internal combustion engine. As mentioned above, according to the fourth embodiment of the carburetor for the internal combustion engine, the fastest portion of the air flow exists always at the fine annular slit at any position of the fuel discharging portion regardless of the opening angle of the throttle valve. Consequently, the fuel is discharged in the form of fine mist mainly from the fastest portion of the annular slit.

The fourth embodiment may form four or more fuel discharging pores 27 having a diameter of about 1±0.5 mm in place of the fine annular slit formed on the inner peripheral side of the venturi tube 20.

FIFTH EMBODIMENT

Figure 20:
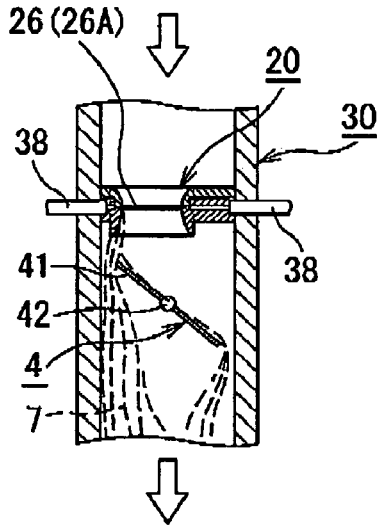
FIG. 20 is a cross-sectional view showing an air flow along an air-flow direction when the throttle valve is opened at an angle of about 40 degrees.
Figure 21:
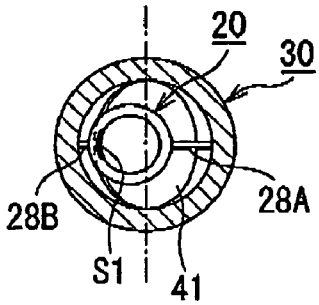
FIG. 21 is an explanatory drawing showing a positional relationship of the annular venturi tube and the throttle valve relative to an inner wall surface of an intake pipe in a plane perpendicular to the air-flow direction of FIG. 20.
Figure 22:
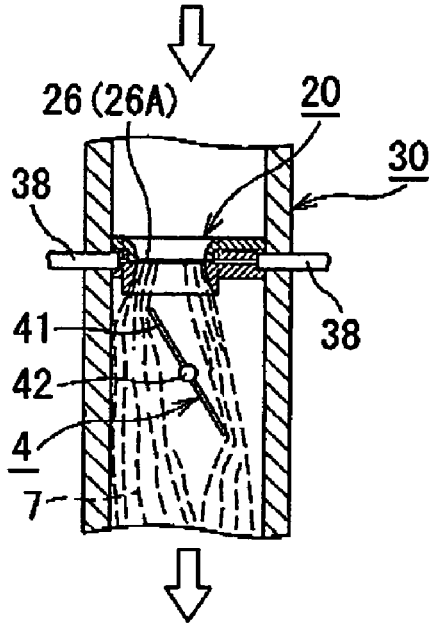
FIG. 22 is a cross-sectional view showing an air flow along an air-flow direction when the throttle valve is opened at an angle of about 60 degrees.
Figure 23:
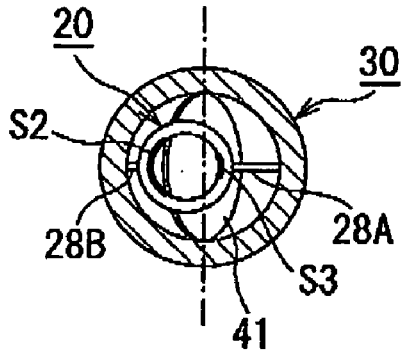
FIG. 23 is an explanatory drawing showing a positional relationship of the annular venturi tube and the throttle valve relative to an inner wall surface of an intake pipe in a plane perpendicular to the air-flow direction of FIG. 22.

FIG. 20 is a cross-sectional view showing an air flow along an air-flow direction when the throttle valve is opened at an angle of about 40 degrees. FIG. 21 is an explanatory drawing showing a positional relationship of the annular venturi tube and the throttle valve relative to an inner wall surface of an intake pipe in a plane perpendicular to the air-flow direction of FIG. 20. FIG. 22 is a cross-sectional view showing an air flow along an air-flow direction when the throttle valve is opened at an angle of about 60 degrees. FIG. 23 is an explanatory drawing showing a positional relationship of the annular venturi tube and the throttle valve relative to an inner wall surface of an intake pipe in a plane perpendicular to the air-flow direction of FIG. 22.

Figure 24:
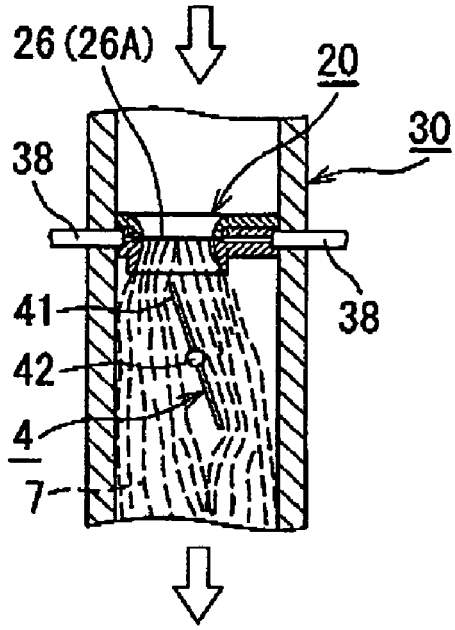
FIG. 24 is a cross-sectional view showing an air flow along an air-flow direction when the throttle valve is opened at an angle of about 70 degrees.
Figure 25:
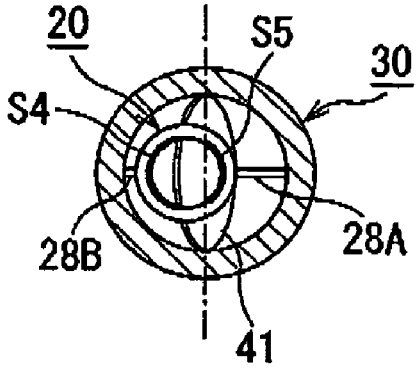
FIG. 25 is an explanatory drawing showing a positional relationship of the annular venturi tube and the throttle valve relative to an inner wall surface of an intake pipe in a plane perpendicular to the air-flow direction of FIG. 24.
Figure 26:
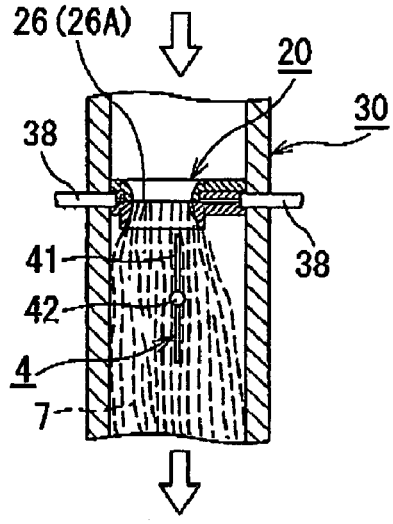
FIG. 26 is a cross-sectional view showing an air flow along an air-flow direction when the throttle valve is full opened.
Figure 27:
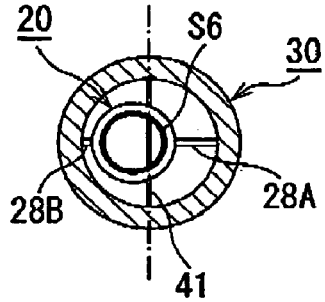
FIG. 27 is an explanatory drawing showing a positional relationship of the annular venturi tube and the throttle valve relative to an inner wall surface of an intake pipe in a plane perpendicular to the air-flow direction of FIG. 26.

FIG. 24 is a cross-sectional view showing an air flow along an air-flow direction when the throttle valve is opened at an angle of about 70 degrees. FIG. 25 is an explanatory drawing showing a positional relationship of the annular venturi tube and the throttle valve relative to an inner wall surface of an intake pipe in a plane perpendicular to the air-flow direction of FIG. 24. FIG. 26 is a cross-sectional view showing an air flow along an air-flow direction when the throttle valve is fully opened. FIG. 27 is an explanatory drawing showing a positional relationship of the annular venturi tube and the throttle valve relative to an inner wall surface of an intake pipe in a plane perpendicular to the air-flow direction of FIG. 26.

In the fifth embodiment, as shown in FIG. 20, FIG. 22, FIG. 24 and FIG. 26, an annular venturi tube 20 has its location shifted from the center but is disposed at a left side in the intake pipe 30 so that, when the throttle valve plate 41 of the throttle valve 4 is opened to an upper left side or clockwise, the annular venturi tube 20 comes near the throttle valve plate 41. Consequently, as shown in FIG. 21, FIG. 23, FIG. 25 and FIG. 27, though two venturi supporting pillars are provided, a right venturi supporting pillar 28A is longer than a left venturi supporting pillar 28B.

As shown in FIG. 20 and FIG. 21, in case the throttle valve plate 41 of the throttle valve 4 is opened at about 40 degrees, an air flow is generated at a clearance between the inner wall surface of the intake pipe 30 and the throttle valve plate 41. Then, the fuel is discharged from a micro-area S1 in the fuel discharging portion 26, 26A composed of the fine annular slit of the venturi tube 20, thereby being atomized so as to generate a flow of the atomized fuel 7 at a left inner wall surface side of the intake pipe 30.

Next, as shown in FIG. 22 and FIG. 23, in case the throttle valve plate 41 of the throttle valve 4 is opened at about 60 degrees, an air flow is generated at a clearance between the inner wall surface of the intake pipe 30 and the throttle valve plate 41. Then, the fuel is discharged from an area S2 in the fuel discharging portion 26, 26A composed of the fine annular slit of the venturi tube 20, thereby being atomized so as to generate a major flow of the atomized fuel 7 at the left inner wall surface side of the intake pipe 30. Moreover, the fuel discharged from an area S3 is atomized so as to generate a minor flow of the atomized fuel 7 at a right inner wall surface side of the intake pipe 30.

Next, as shown in FIG. 24 and FIG. 25, in case the throttle valve plate 41 of the throttle valve 4 is opened at about 70 degrees, an air flow is generated at a clearance between the inner wall surface of the intake pipe 30 and the throttle valve plate 41. Then, the fuel is discharged from an area S4 in the fuel discharging portion 26, 26A composed of the fine annular slit of the venturi tube 20, thereby being atomized so as to generate a major flow of the atomized fuel 7 at the left inner wall surface side of the intake pipe 30. Moreover, the fuel discharged from an area S5 is atomized so as to generate a minor flow of the atomized fuel 7 at a right inner wall surface side of the intake pipe 30.

Next, as shown in FIG. 26 and FIG. 27, in case the throttle valve plate 41 of the throttle valve 4 is fully opened, an air flow is generated in an overall area of the intake pipe 30. Then, the fuel is discharged from an overall area S6 in the fuel discharging portion 26, 26A composed of the fine annular slit of the venturi tube 20, thereby being atomized so as to generate a major flow of the atomized fuel 7 at the overall area of the intake pipe 30.

As described above, the annular venturi tube 20 is located at the shifted position from the center to a side of the inner wall surface of the intake pipe 30, i.e. at a side where the annular venturi tube 20 comes near the throttle valve 4 when it opens. Thereby, even if the throttle valve 4 slightly opens, the air flow generated at the clearance becomes a flow to the side of the fuel discharging portion 26, 26A composed of the fine annular slit of the venturi tube 20. Therefore, the air flow corresponding to the opening of the throttle valve 4 flows inside the annular venturi tube 20. Accordingly, the air is sure to flow inside the annular venturi tube 20 even when the throttle valve 4 opens at a small opening angle. Then, the atomized fuel 7 can be supplied from the fuel discharging portion 26, 26A. Moreover, as the opening angle of the throttle valve 4 becomes large, the throttle valve 4 guides the atomized fuel 7 so as to be uniformly diffused. Consequently, the atomization is facilitated at any opening angle of the throttle valve 4, thereby improving the combustion characteristics in the internal combustion engine.

The annular venturi tube 20 may be located at a shifted position from the center to the inner wall side of the intake pipe 30 or at a side where the annular venturi tube 20 comes apart from the throttle valve 4 when it opens. In this case, the air corresponding to the opening angle of the throttle valve 4 flows inside the annular venturi tube 20 in the same way. Consequently, the same function and effects are expected.

Moreover, an annular body of the venturi tube 20 has an inner diameter of an upstream side decreased sharply and an inner diameter of a downstream side increased gradually compared with the inner diameter change of the upstream side. Thus, the flow velocity becomes substantially the highest at the fuel discharging portion 26, 26A of the annular venturi tube 20, so that the flow becomes tidy and ordered. Moreover, the flow velocity becomes lower step by step as it overpasses the fuel discharging portion 26, 26A, so that the air flow is easy to be spread. Thus, the air and the atomized fuel are mixed well, so that the combustion characteristics in the internal combustion engine can be improved more.

Figure 28:
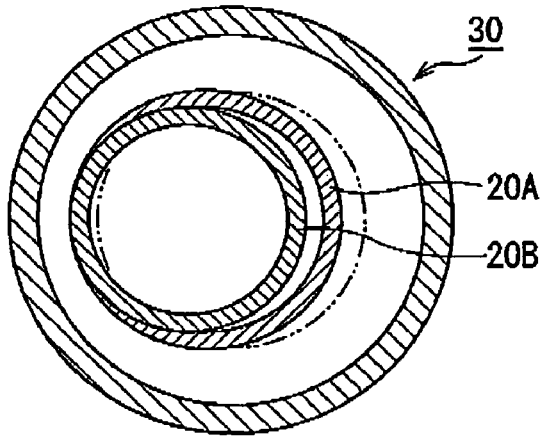
FIG. 28 is an explanatory drawing showing a positional relationship of an annular venturi tube to an inner wall surface of an intake pipe of a carburetor for an internal combustion engine according to a fifth embodiment of the invention.
Figure 29:
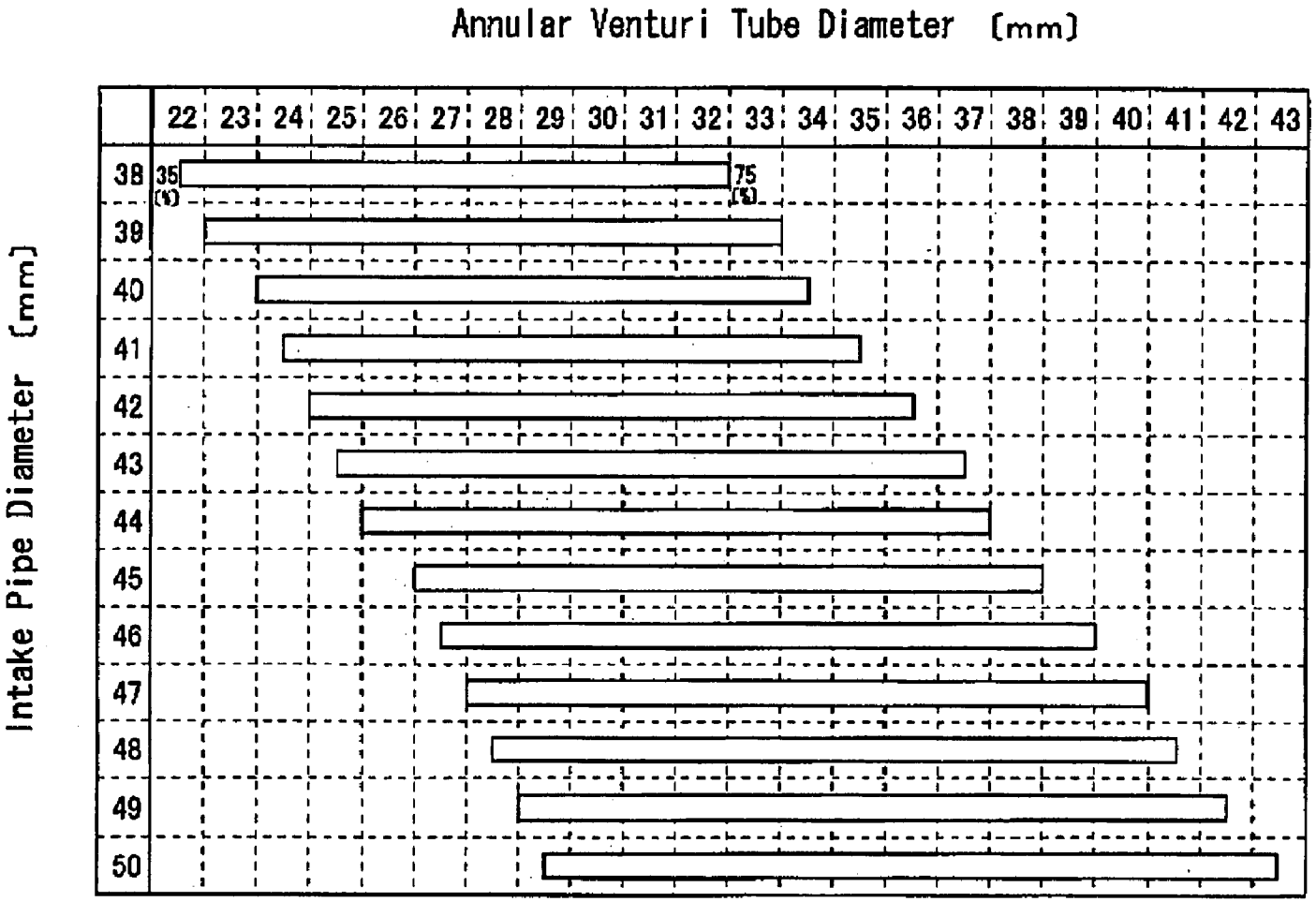
FIG. 29 is an explanatory chart showing an optimal range of an area ratio of an air conduit that is divided into an inside part and an outside part by the annular venturi tube in the intake pipe of the carburetor for the internal combustion engine according to the fifth embodiment of the invention.

Next described are a positional relationship between the annular venturi tube 20 and the intake pipe 30 and an area ratio of the air passages divided into the inside and the outside of the annular venturi tube 20 in the carburetor of the internal combustion engine according to the fifth embodiment, referring to FIG. 28 and FIG. 29.

In FIG. 28, an inside area of the intake pipe 30 is determined by a diameter thereof, while an inside area of an annular venturi tube 20A is decided by a diameter thereof The inside area of the annular venturi tube 20A is about 43% to the inside area (100%) of the intake pipe 30. The annular venturi tube 20A is shifted leftward from a center at about one fifth of a radius thereof. An inside area of an annular venturi tube 20B is decided by a diameter thereof. The inside area of the annular venturi tube 20B is about 37% to the inside area of the intake pipe 30. The annular venturi tube 20B is shifted leftward from a center at about three tenth of a radius thereof In the fifth embodiment, the annular venturi tube 20A, 20B is located at a shifted position from the center to the inner wall side of the intake pipe 30 so that it comes near the throttle valve 4 when it opens. Specifically, a distance from the inner wall surface of the intake pipe 30 to an outer peripheral surface of the annular venturi tube 20A, 20B is about one fifth of the radius of the intake pipe 30. An air passage is formed while such distance is kept constant.

According to experiments of the inventors, as shown by the annular venturi tube 20A, 20B in FIG. 29, the area of the inside air passage is changed to the inside area 100% of the intake pipe 30. As a result, it was confirmed that good combustion characteristics were attainable even if the area of the air passage of the venturi tube was lessened up to about 35%. To the contrary, it was confirmed that good combustion characteristics were attainable even if the area of the air passage of the venturi tube was enlarged up to about 75% relative to the inside area 100% of the intake pipe 30. This means that the area ratio of the air passages divided into the inside and the outside of the annular venturi tube 20A, 20B in the intake pipe 30 can be set such that the area of the inside air passage is within a range of 55±20% to the area of the outside air passage.

At this time, the air introduced in the intake pipe 30 is mixed with the fuel 7 atomized by passing the inside of the annular venturi tube 20A, 20B. Then, the mixed fuel 7 is surrounded by the air passing the outside of the annular venturi tube 20A, 20B. Therefore, spreading or mixing of the atomized fuel 7 is more facilitated. Consequently, the fuel is hard to be attached on the wall spice of the intake manifold downstream of the intake pipe 30 or on the wall surface of the combustion chamber of the internal combustion engine. As a result, the fuel 7 supplied into the combustion chamber of the internal combustion engine becomes a very uniformly mixed air-fuel mixture. Then, most of the fuel constitutes to combustion. Thus, it is possible to improve the output, the fuel consumption and the exhaust gas emission of the internal combustion engine.

SIXTH EMBODIMENT

Figure 30:
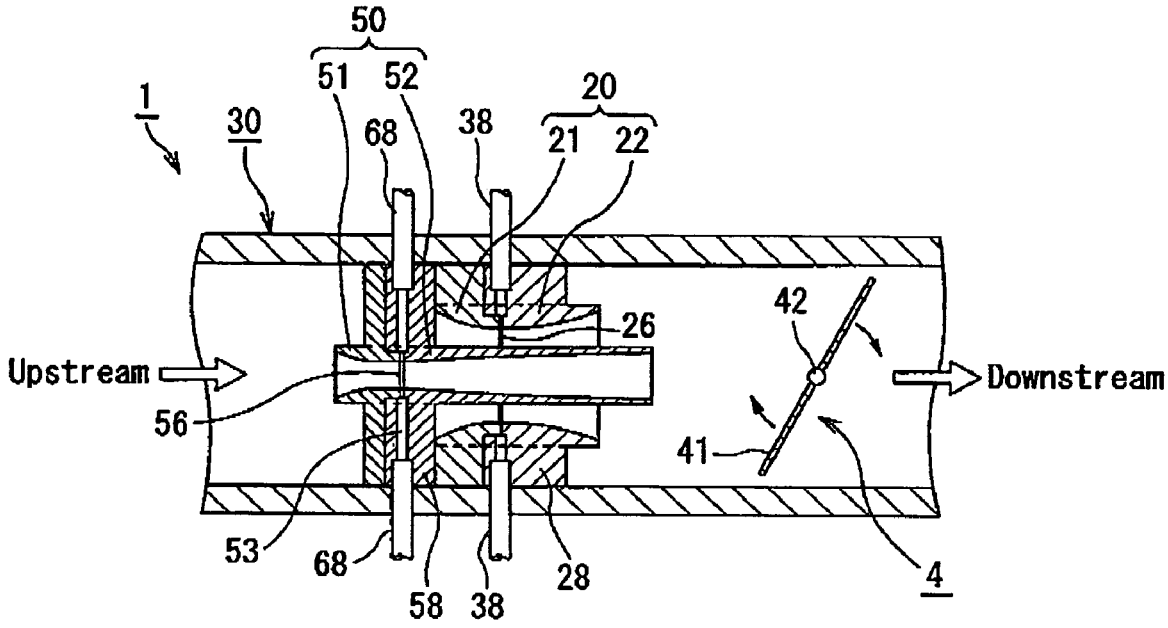
FIG. 30 is a cross-sectional view showing a throttle valve, an annular venturi tube and an annular center venturi tube along an air flow direction in a carburetor for a internal combustion engine according to a sixth embodiment of the invention.
Figure 31:
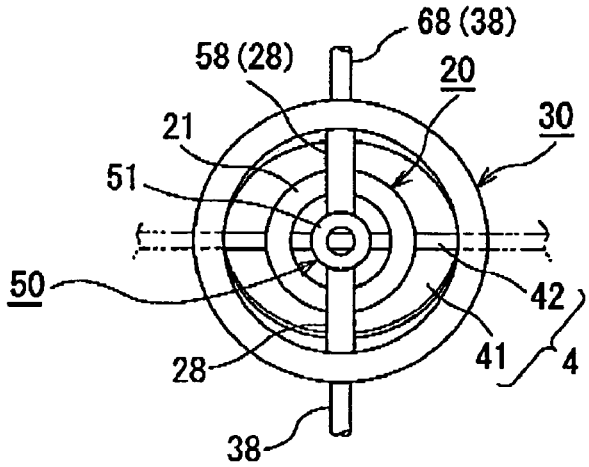
FIG. 31 is a side view showing the carburetor of FIG. 30 seen from a left side.

FIG. 30 is a cross-sectional view showing a throttle valve, an annular venturi tube and an annular center venturi tube along an air flow direction in a carburetor for a internal combustion engine according to a sixth embodiment of the invention. FIG. 31 is a side view showing the carburetor of FIG. 30 seen from a left side.

Referring to FIG. 30 and FIG. 31, in the sixth embodiment, the throttle valve 4 and an annular venturi tube 20 are disposed at a prescribed interval in the intake pipe 30. An annular center venturi tube 50 is disposed at an inner peripheral side of the annular venturi tube 20. The annular center venturi tube 50 is made in a length that extends a length of the annular venturi tube 20 in an air flow direction on both sides. The annular center venturi tube 50 has an upstream annular center venturi portion 51 and a downstream annular center venturi portion 52 that have a circular cross-section and increase the air flow velocity. The annular center venturi tube 50 further has two venturi supporting pillars 58 that form fuel supply routes. The annular center venturi tube 50 is fixed in the intake pipe 30 by press fitting or the like.

A fuel discharging portion 56 of the annular center venturi tube 50 is formed on inner peripheral sides of the upstream and the downstream annular center venturi portions 51 and 52. The fuel discharging portion 56 is structured in the same way as the fuel discharging portion 26 of the annular venturi tube 20. Therefore, detailed description thereof will be omitted. Moreover, a coupling relation between the upstream and the downstream annular center venturi portions 51 and 52 of the center venturi tube 50 is the same as that of the upstream and the downstream annular center venturi portions 21 and 22 of the annular venturi tube 20. Therefore, detailed description thereof will be omitted.

The fuel is supplied from the fuel tank via the diaphragm fuel pump or the like and introduced from a fuel supplying pipe 68 provided on the intake pipe 30. Then, the fuel passes the fuel supplying routes 53, thereby being atomized and discharged from the annular fuel discharging portion 66. At this time, the fuel is continuously discharged from the fuel discharging portion 56, which is composed of the fine annular slit at the inner peripheral side of the annular center venturi tube 50 and which is a fastest portion of the air flow decided mainly by the opening angle of the throttle valve 4, toward a downstream side in the form of a fine mist.

The sixth embodiment may form four or more fuel discharging pores having a diameter of about 1±0.5 mm in place of the fuel discharging portion 56 made of the fine annular slit formed on the inner peripheral side of the annular center venturi tube 50.

According to the sixth embodiment of the carburetor for the internal combustion engine, the annular center venturi tube 50 is provided at an inside of the inner wall of the annular venturi tube 20. The annular center venturi tube 50 forms air passages at an inside and an outside thereof. The annular center venturi tube 50 has an annular body formed with the length extending the length of the annular venturi tube 20 on the both sides. The annular center venturi tube 50 has the fuel discharging portion 56 formed at the inner peripheral side such that it atomizes the fuel by the air flow. Therefore, the fastest portion of the air flow velocity exists always at any portion of the annular center venturi tube 50 regardless of the opening angle of the throttle valve 4. The fuel is atomized mainly at the fastest portion of the air flow velocity. Moreover, the annular center venturi tube 50 is made of the annular body that forms the air passages at the inside and the outside thereof. Thus, the air is spread to both sides from the annular center venturi tube 50 as a center, so that the spread of the atomized fuel is enlarged. As a result, the atomization of the fuel is uniformly carried out overall, thereby improving the output, the fuel consumption and the exhaust gas emission of the internal combustion engine.

The fuel discharging portion 56 formed at the inner peripheral side of the annular center venturi tube 50 is made of the fine annular slit. Therefore, the fastest portion of the air flow velocity exists always at any position of the fine annular slit 56 of the annular center venturi tube 50 regardless of the opening angle of the throttle valve 4. The fuel is discharged to be atomized mainly from the fastest portion of the annular slit 56. Moreover, the air passages are formed at the inside and the outside of the annular center venturi tube 50. Thus, the air or the fuel is spread to both sides from the fuel discharging portion 56 as a center, so that the spread of the atomized fuel is enlarged. Accordingly, the uniform atomization of the fuel is facilitated in the intake pipe 30, thereby improving the output, the fuel consumption and the exhaust gas emission of the internal combustion engine as a result.

The fuel discharging portion 56 formed at the inner peripheral side of the annular center venturi tube 50 may be composed of four or more pores. In this case, there always exist positions of the pores that correspond to the fastest portion of the air flow velocity of the annular center venturi tube 50 regardless of the opening angle of the throttle valve 4. The fuel is discharged in the form of fine mist mainly from the pores where the flow velocity is the. Moreover, the air passages are formed at the inside and the outside of the annular center venturi tube 50. Thus, the uniform atomization of the fuel is facilitated in the intake pipe 30, thereby improving the output, the fuel consumption and the exhaust gas emission of the internal combustion engine as a result.

The fuel discharging portion 56 formed at the inner peripheral side of the annular center venturi tube 50 may be composed of a fine annular slit, while the fuel being guided to the fine annular slit via plural pores formed inside thereof. In this case, the plurally formed pores can specify points where the fuel is guided to the fuel discharging portion. It is unnecessary to guide the fuel from the pores to the fuel discharging portion at unnecessary points. Therefore, no excessive fuel is produced at the fuel discharging portion composed of the fine annular slit when the throttle valve 4 is closed.

The annular body of the annular center venturi tube 50 is made of a round annular body. Therefore, manufacture of the annular center venturi tube 50 is easy. Moreover, there exists always a fastest portion of the air flow velocity of the annular center venturi tube regardless of the opening angle of the throttle valve 4. Thus, the fuel is discharged in the form of mist mainly from the fastest portion of the air flow velocity. Accordingly, the atomization of the fuel is facilitated, thereby improving the output, the fuel consumption and the exhaust gas emission of the internal combustion engine.

The fuel is supplied from one or more points at the side of the intake pipe 30 to the annular center venturi tube 50. Therefore, the fuel is uniformly supplied to the fuel discharging portion where the fuel is atomized. As a result, the uniformly atomized fuel can be supplied from the annular center venturi tube 50, thereby improving the output, the fuel consumption and the exhaust gas emission of the internal combustion engine.

The annular center venturi tube 50 is disposed at the side of the inner wall of the intake pipe 30, while being shifted from the center thereof corresponding to the shift of the annular venturi tube 20. Therefore, if the throttle valve 4 opens slightly, the air flow becomes a flow at the side of the annular venturi tube 20, so that the air flow corresponding to the opening angle of the throttle valve 4 flows inside the annular venturi tube 20. Then, the air flow is sure to flow inside the annular venturi tube 20 even if the opening angle of the throttle valve 4 is small so that uniformly atomized fuel is supplied. Moreover, if the opening angle of the throttle valve 4 becomes large, the flow at the side of the annular center venturi tube 50 is added, so that the air flow corresponding to the opening angle of the throttle valve 4 flows inside the annular venturi tube 20 and the annular center venturi tube 50. Consequently, the air flow is sure to flow inside the annular venturi tube 20 and the annular center venturi tube 50 if the throttle valve 4 opens at a large angle, that the uniformly atomized fuel is supplied. Accordingly, the combustion characteristics can be improved for any opening angle of the throttle valve 4.

The annular body of the annular center venturi tube 50 has the upstream side inner diameter decreased sharply and the downstream side inner diameter increased gradually compared with the inner diameter change of the upstream side. Therefore, the flow velocity becomes maximum at the fuel discharging portion 56 of the annular center venturi tube 50, so that the flow becomes tidy. Moreover, the flow velocity becomes lower step by step if passing over the fuel discharging portion 56 of the annular center venturi tube 50. Then, the air becomes easy to be spread, so that the mixture of the air and the atomized fuel is facilitated, thereby improving the combustion characteristics.

The annular body of the annular center venturi tube 50 may have an upstream side outer diameter increased sharply and a downstream side outer diameter increased gradually compared with the outer diameter change of the upstream side. In this case, the flow velocity increases more at the fuel discharging portion 56 of the annular center venturi tube 50 that faces a maximum outer diameter portion of the annular center venturi tube 50. Then, the air flow becomes tidy and ordered. Moreover, the flow velocity decreases step by step if passing over the fuel discharging portion 56 of the annular center venturi tube 50 that faces a maximum outer diameter portion of the annular center venturi tube 50. Then, the air becomes easy to be spread, so that the mixture of the air and the atomized fuel is facilitated, thereby improving more the combustion characteristics.

SEVENTH EMBODIMENT

Figure 32:
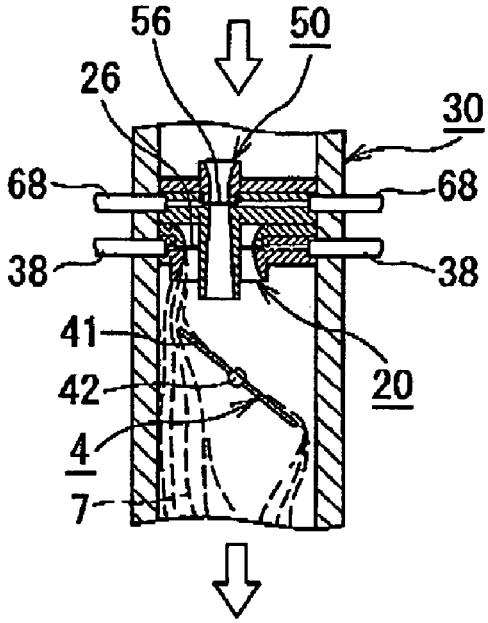
FIG. 32 is a cross-sectional view showing an air flow along an air-flow direction when the throttle valve is opened at an angle of about 40 degrees.
Figure 33:
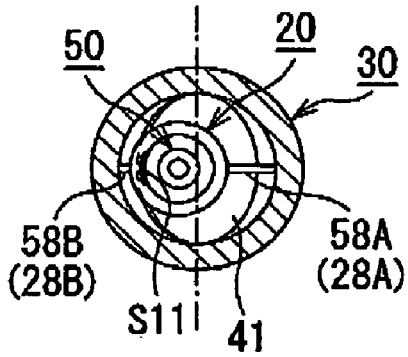
FIG. 33 is an explanatory drawing showing a positional relationship of the annular venturi tube, the annular center venturi tube and the throttle valve relative to an inner wall surface of an intake pipe in a plane perpendicular to the air-flow direction of FIG. 32.
Figure 34:
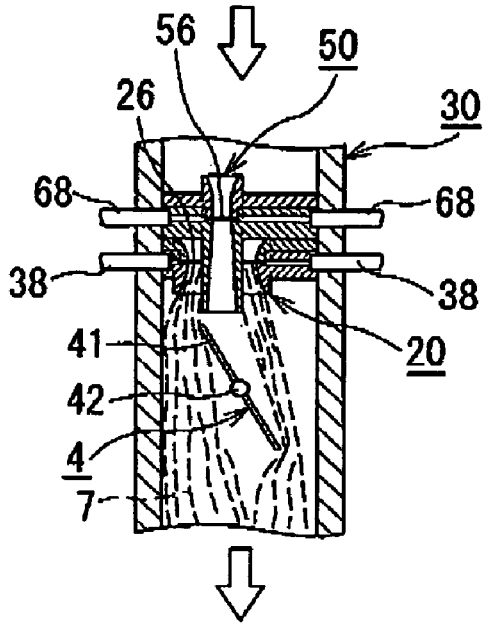
FIG. 34 is a cross-sectional view showing an air flow along an air-flow direction when the throttle valve is opened at an angle of about 60 degrees.
Figure 35:
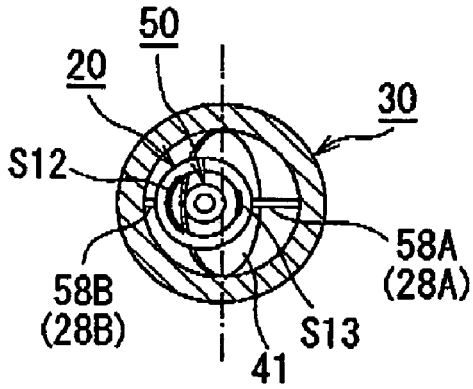
FIG. 35 is an explanatory drawing show a positional relationship of the annular venturi tube, the annular center venturi tube and the throttle valve relative to an inner wall surface of an intake pipe in a plane perpendicular to the air-flow direction of FIG. 34.

FIG. 32 is a cross-sectional view showing an air flow along an air-flow direction when the throttle valve is opened at an angle of about 40 degrees. FIG. 33 is an explanatory drawing showing a positional relationship of the annular venturi tube, the annular center venturi tube and the throttle valve relative to an inner wall surface of an intake pipe in a plane perpendicular to the air-flow direction of FIG. 32. FIG. 34 is a cross-sectional view showing an air flow along an air-flow direction when the throttle valve is opened at an angle of about 60 degrees. FIG. 35 is an explanatory drawing showing a positional relationship of the annular venturi tube, the annular center venturi tube and the throttle valve relative to an inner wall surface of an intake pipe in a plane perpendicular to the air-flow direction of FIG. 34.

Figure 36:
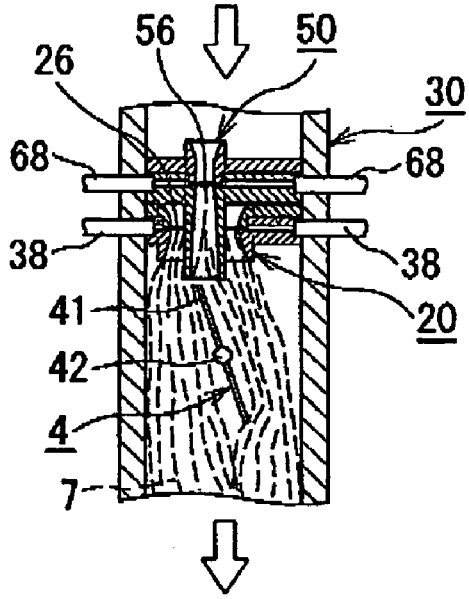
FIG. 36 is a cross-sectional view showing an air flow along an air-flow direction when the throttle valve is opened at an angle of about 70 degrees.
Figure 37:
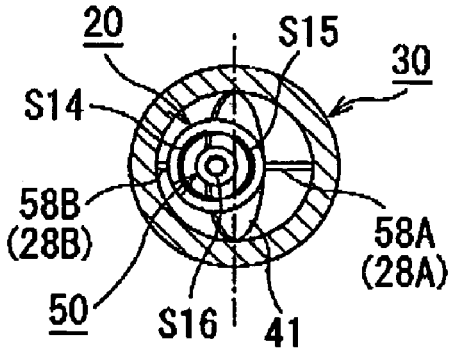
FIG. 37 is an explanatory drawing showing a positional relationship of the annular venturi tube, the annular center venturi tube and the throttle valve relative to an inner wall surface of an intake pipe in a plane perpendicular to the air-flow direction of FIG. 36.
Figure 38:
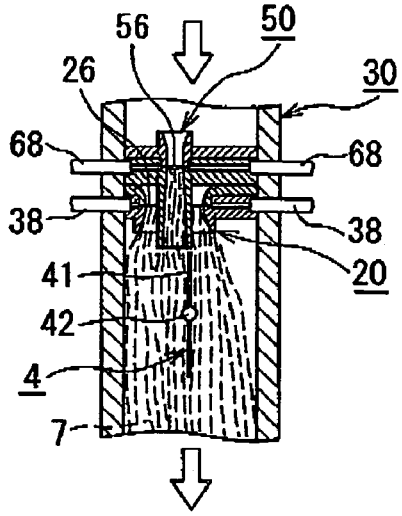
FIG. 38 is a cross-sectional view showing an air flow along an air-flow direction when the throttle valve is fully opened.
Figure 39:
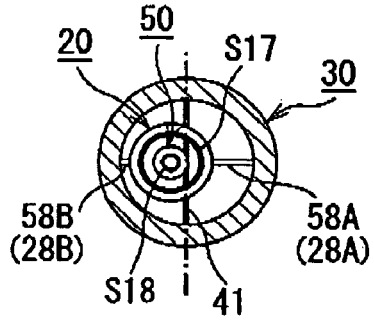
FIG. 39 is an explanatory drawing showing a positional relationship of the annular venturi tube, the annular center venturi tube and the throttle valve relative to an inner wall surface of an intake pipe in a plane perpendicular to the air-flow direction of FIG. 38.

FIG. 36 is a cross-sectional view showing an air flow along an air-flow direction when the throttle valve is opened at an angle of about 70 degrees. FIG. 37 is an explanatory drawing showing a positional relationship of the annular venturi tube, the annular center venturi tube and the throttle valve relative to an inner wall surface of an intake pipe in a plane perpendicular to the air-flow direction of FIG. 36. FIG. 38 is a cross-sectional view showing an air flow along an air-flow direction when the throttle valve is fully opened FIG. 39 is an explanatory drawing showing a positional relationship of the annular venturi tube, the annular center venturi tube and the throttle valve relative to an inner wall surface of an intake pipe in a plane perpendicular to the air-flow direction of FIG. 38.

In the seventh embodiment, as shown in FIG. 32, FIG. 34, FIG. 36 and FIG. 38, an annular venturi tube 20 and an annular center venturi tube 50 have their locations shifted from the center but are disposed at a left side in the intake pipe 30 so that, when the throttle valve plate 41 of the throttle valve 4 is opened to an upper left side or clockwise, the annular venturi tube 20 and the annular center venturi tube 50 come near the throttle valve plate 41. Consequently, as shown in FIG. 33, FIG. 35, FIG. 37 and FIG. 39, though two venturi supporting pillars are provided respectively for the annular center venturi tube 50 and the annular venturi tube 20, right venturi supporting pillars 58A and 28A are longer than left venturi supporting pillars 58B and 28B.

As shown in FIG. 32 and FIG. 33, in case the throttle valve plate 41 of the throttle valve 4 is opened at about 40 degrees, an air flow is generated at a clearance between the inner wall surface of the intake pipe 30 and the throttle valve plate 41. Then, the fuel is discharged from a micro-area S11 in the fuel discharging portion 26 composed of the fine annular slit of the venturi tube 20, thereby being atomized so as to generate a flow of the atomized fuel 7 at a left inner wall surface side of the intake pipe 30. At such opening angle of the throttle valve 4, there is no portion of an air flow having a fast flow velocity in an air passage inside the annular center venturi tube 50. Then, the fuel was hardly discharged from the fuel discharging portion 56 made of the fine annular slit of the annular center venturi tube 50.

Next, as shown in FIG. 34 and FIG. 35, in case the throttle valve plate 41 of the throttle valve 4 is opened at about 60 degrees, an air flow is generated at a clearance between the inner wall surface of the intake pipe 30 and the throttle valve plate 41. Then, the fuel is discharged from an area S12 in the fuel discharging portion 26 composed of the fine annular slit of the venturi tube 20, thereby being atomized so as to generate a major flow of the atomized fuel 7 at the left inner wall surface side of the intake pipe 30. Moreover, the fuel discharged from an area S13 is atomized so as to generate a minor flow of the atomized fuel 7 at a right inner wall surface side of the intake pipe 30.

Next, as shown in FIG. 36 and FIG. 37, in case the throttle valve plate 41 of the throttle valve 4 is opened at about 70 degrees, an air flow is generated at a clearance between the inner wall surface of the intake pipe 30 and the throttle valve plate 41. Then, the fuel is discharged from an area S14 in the fuel discharging portion 26 composed of the fine annular slit of the venturi tube 20, thereby being atomized so as to generate a major flow of the atomized fuel 7 at the left inner wall surface side of the intake pipe 30. Moreover, the fuel discharged from an area S15 is atomized so as to generate a minor flow of the atomized fuel 7 at a right inner wall surface side of the intake pipe 30.

Moreover, if the throttle valve 4 opens to such a degree, the fuel starts being discharged from an area S16 in the fuel discharging portion 56 made of the fine annular slit of the annular center venturi tube 50. Then, the fuel starts being atomized at a center area of the intake pipe 30 so as to be mixed with the atomized fuel 7 discharged from the areas S14 and S15 in the fuel discharging portion 26 of the annular venturi tube 20. Accordingly, at such opening angle of the throttle valve 4, the atomized fuel 7 increases so as to improve fuel supply at a high rotation side of the internal combustion engine.

Next, as shown in FIG. 38 and FIG. 39, in case the throttle valve plate 41 of the throttle valve 4 is fully opened, an air flow is generated in an overall area of the intake pipe 30. Then, the fuel is discharged from an overall area S17 in the fuel discharging portion 26 composed of the fine annular slit of the venturi tube 20, thereby being atomized so as to generate a major flow of the atomized fuel 7 at the overall area of the intake pipe 30. Moreover, if the throttle valve 4 becomes the fully opened state, the fuel is also discharged from an area S18 in the fuel discharging portion 56 made of the fine annular slit of the annular center venturi tube 50. Then, the fuel starts being atomized at a center area of the intake pipe 30 so as to be mixed with the atomized fuel 7 discharged from the area S17 in the fuel discharging portion 26 of the annular venturi tube 20. Accordingly, at the full opening angle of the throttle valve 4, the atomized fuel 7 becomes maximum so as to supply the fuel enough and to a required level at the high rotation side of the internal combustion engine.

As described above, the annular venturi tube 20 is located at the shifted position from the center to a side of the inner wall surface of the intake pipe 30, i.e. at a side where the annular venturi tube 20 comes near the throttle valve 4 when it opens. Thereby, even if the throttle valve 4 slightly opens, the air flow generated at the clearance becomes a flow to the side of the fuel discharging portion 26 composed of the fine annular slit of the venturi tube 20. Therefore, the air flow corresponding to the opening of the throttle valve 4 flows inside the annular venturi tube 20. Moreover, the annular center venturi tube 50 is disposed more inside than the inner wall of the annular venturi tube 20. Therefore, the air flow corresponding to the large opening angle side of the throttle valve 4 flows inside the annular center venturi tube 50.

Accordingly, the air is sure to flow inside the annular venturi tube 20 even when the throttle valve 4 opens at a small opening angle. Then, the atomized fuel 7 can be supplied from the fuel portion 26. Moreover, as the opening angle of the throttle valve 4 becomes large, the air flow also flows inside the annular center venturi tube 50, so that the fuel from the fuel discharging portion 56 is also atomized and mixed well with the fuel 7. In addition, the throttle valve 4 guides the atomized fuel 7 so as to be uniformly diffused. Consequently, the atomization is facilitated at any opening angle of the throttle valve 4, thereby improving the combustion characteristics in the internal combustion engine.

The annular venturi tube 20 and the annular center venturi tube 50 may be located at a shifted position from the center to the inner wall side of the intake pipe 30 or at a side where the annular venturi tube 20 and the annular center venturi tube 50 come apart from the throttle valve 4 when it opens. In this case, the air corresponding to the opening an of the throttle valve 4 flows inside the annular venturi tube 20 and the annular center venturi tube 50 in the same way, Consequently, the same function and effects are expected.

Moreover, an annular body of the venturi tube 20 has an inner diameter of an upstream side decreased sharply and an inner diameter of a downstream side increased gradually compared with the inner diameter change of the upstream side. Thus, the flow velocity becomes maximum at the fuel discharging portion 26 of the annular venturi tube 20, so that the flow becomes tidy and ordered. Moreover, the flow velocity becomes lower step by step as it overpasses the fuel discharging portion 26, so that the air flow is easy to be spread. Thus, the air and the atomized fuel are mixed well, so that the combustion characteristics in the internal combustion engine can be improved more.

In the same way, an annular body of the annular center venturi tube 50 has an inner diameter of an upstream side decreased sharply and an inner diameter of a downstream side increased gradually compared with the inner diameter change of the upstream side. Thus, the flow velocity becomes maximum at the fuel discharging portion 56 of the annular center venturi tube 50, so that the flow becomes tidy and ordered Moreover, the flow velocity becomes lower step by step as it overpasses the fuel discharging portion 56, so that the air flow is easy to be spread. Thus, the air and the atomized fuel are mixed well, so that the combustion characteristics at the high rotation side in the internal combustion engine can be improved more.

Figure 40:
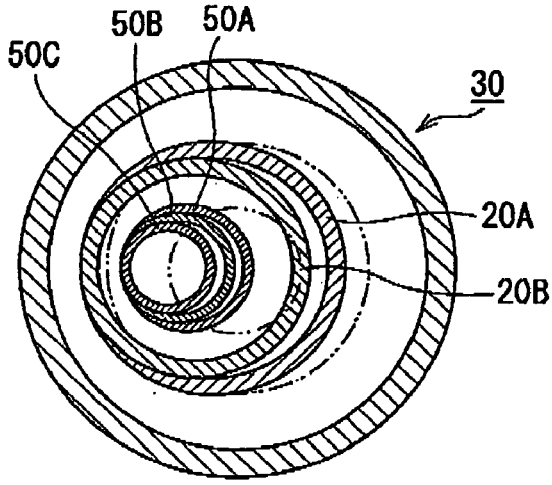
FIG. 40 is an explanatory drawing showing a positional relationship of an annular venturi tube and an annular center venturi tube relative to an inner wall surface of an intake pipe in a carburetor for an internal combustion engine according to a seventh embodiment of the invention.
Figure 41:
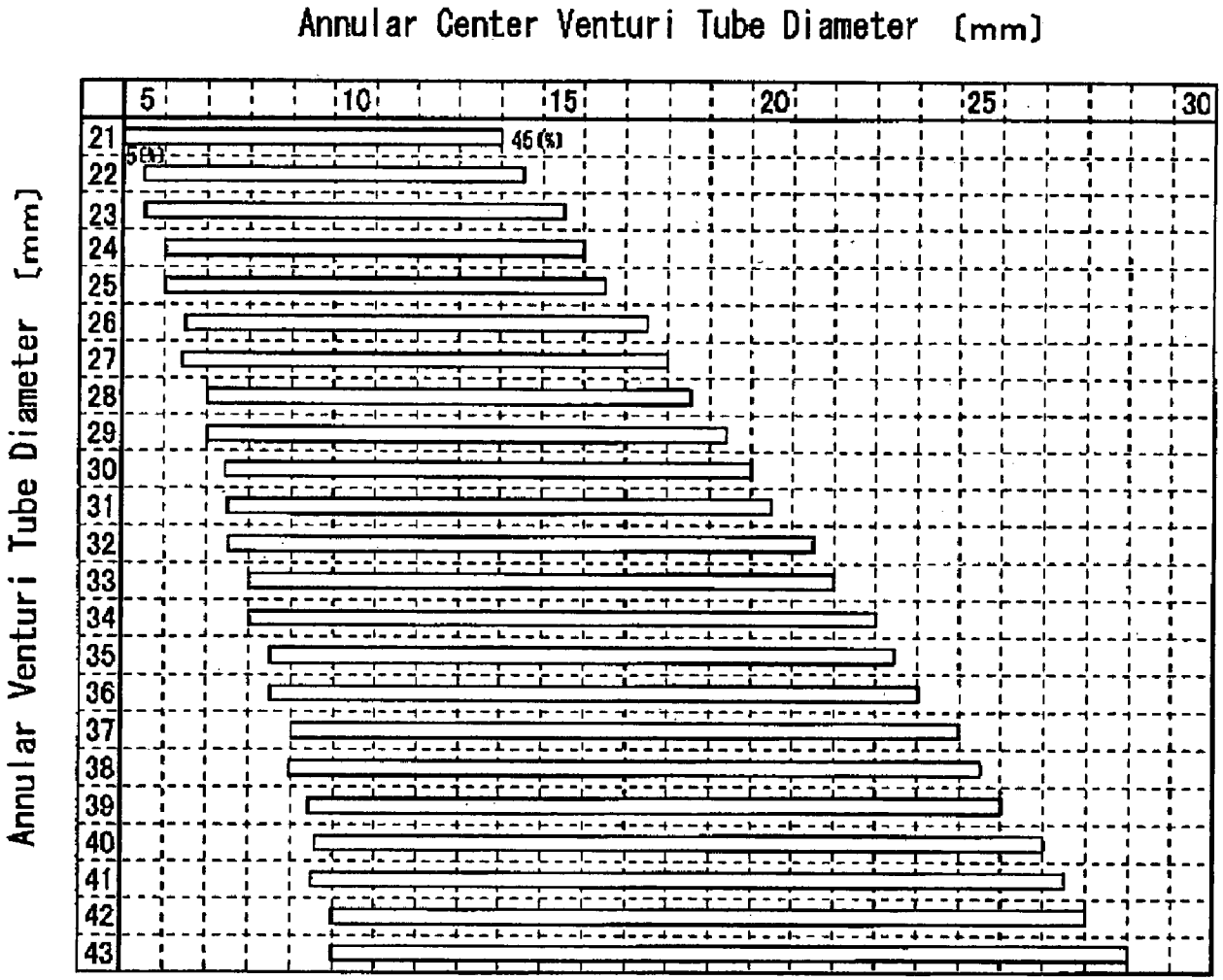
FIG. 41 is an explanatory chart showing an optimal range of an area ratio of an air conduit that is divided into an inside part and an outside part by the annular venturi tube in the intake pipe of the carburetor for the internal combustion engine according to the seventh embodiment of the invention.

Next described are a positional relationship between the annular venturi tube 20 and the annular center venturi tube 50 and the intake pipe 30 and an area ratio of the air passages divided into the inside of the annular center venturi tube 50 and a portion from the outside of the annular center venturi tube 50 to the inside of the annular venturi tube 20 in the carburetor of the internal combustion engine according to the seventh embodiment, referring to FIG. 40 and FIG. 41 showing experiment results by the inventors.

In FIG. 40, an inside area of the intake pipe 30 is determined by a diameter thereof, while an inside area of an annular venturi tube 20A is decided by a diameter thereof. As described referring to FIG. 13, the inside area of the annular venturi tube 20A is about 43% to the inside area (100%) of the intake pipe 30. The annular venturi tube 20A is shifted leftward from a center at about one fifth of a radius thereof. An inside area of an annular venturi tube 20B is decided by a diameter thereof. The inside area of the annular venturi tube 20B is about 37% to the inside area of the intake pipe 30. The annular venturi tube 20B is shifted leftward from a center at about three tenth of a radius thereof.

In the seventh embodiment, the annular venturi tube 20A, 20B is located at a shifted position from the center to the inner wall side of the intake pipe 30 so that it comes near the throttle valve 4 when it opens. Specifically a distance from the inner wall surface of the intake pipe 30 to an outer peripheral surface of the annular venturi tube 20A, 20B is about one fifth of the radius of the intake pipe 30. An air passage is formed while such distance is kept constant. Moreover, the annular center venturi tube 50A, 50B, 50C is located at a shifted position corresponding to the shift of the annular venturi tube 20A, 20B toward the inner wall side of the intake pipe 30.

According to experiments of the inventors, as shown by the annular center venturi tube 50A, 50B, 50C in FIG. 41, the area of the inside air passage is changed to the inside area 100% of the annular venturi tube 20. As a result, it was confirmed that good combustion characteristics were attainable even if the area of the air passage of the center venturi tube was lessened up to about 5%. To the contrary, it was confirmed that good combustion characteristics were attainable even if the area of the air passage of the center venturi tube was enlarged up to about 45% relative to the inside area 100% of the annular venturi tube 20. This means that the area ratio of the inner air passage defined by the inside of the annular center venturi tube 50 and the outer air passage defined between the outer peripheral surface of the annular center venturi tube 50 and the inner peripheral surface of the annular venturi tube 20 can be set as follows. That is, the area of the inner air passage can be set within a range of 25±20% to the area of the outer air passage.

At this time, the air introduced in the intake pipe 30 is mixed with the fuel 7 atomized by passing the inside of the annular venturi tube 20A, 20B and the inside of the annular center venturi tube 50A, 50B, 50C. The mixed fuel 7 is surrounded by the air passing the outside of the annular venturi tube 20A, 20B. Therefore, spreading or mixing of the atomized fuel 7 is more facilitated. Consequently, the fuel is hard to be attached on the wall surface of the intake manifold downstream of the intake pipe 30 or on the wall surface of the combustion chamber of the internal combustion engine. As a result, the fuel 7 supplied into the combustion chamber of the internal combustion engine becomes a very uniformly mixed air-fuel mixture. Then, most of the fuel constitutes to combustion. Thus, it is possible to improve the output, the fuel consumption and the exhaust gas emission of the internal combustion engine.

Moreover, the annular body of the annular center venturi tube 50 may have an upstream side outer diameter increased sharply and a downstream side outer diameter increased gradually compared with the outer diameter change of the upstream side. In this case, the flow velocity of the air flow can be increased at the fuel discharging portion 26 of the annular venturi tube 20. Therefore, it is possible to facilitate atomization of the fuel discharged from the fuel discharging portion 26.

The preferred embodiments described herein are illustrative and not restrictive, the scope of the invention being indicated in the appended claims and all variations which come within the meaning of the clams are intended to be embraced therein.

The invention claimed is:

1. A carburetor for an internal combustion engine, comprising:

an intake pipe having an inner wall, the intake pipe supplying a fuel and an air for the internal combustion engine;

a throttle valve disposed inside the intake pipe; and an annular venturi tube disposed at an upstream side or a downstream side of the throttle valve inside the intake pipe, the annular venturi tube being made of an annular body defining an inside air passage and an outside air passage inside an inner wall of the intake pipe, the annular body having a fuel discharging portion formed at an inner peripheral side thereof so to atomize the fuel by an air flow, wherein said carburetor further comprises an annular center venturi tube disposed at an inside of an inner wall of the annular venturi tube, the annular center venturi tube defining an inside air passage and an outside air passage inside the annular venturi tube, the annular center venturi tube having an annular body formed into a length that extends a length of the annular venturi tube in an air flow direction on both sides, the annular body of the annular center venturi tube having a fuel discharging portion formed at an inner peripheral side thereof so to atomize the fuel by an air flow.

2. A carburetor for an internal combustion engine according to claim 1, in which the fuel discharging portion of the annular center venturi tube has a fine annular slit formed on the inner peripheral side of the annular body thereof.

3. A carburetor for an internal combustion engine according to claim 1, in which the fuel discharging portion of the annular center venturi tube has four or more pores formed on the inner peripheral side of the annular body thereof.

4. A carburetor for an internal combustion engine according to claim 1, in which the fuel discharging portion of the annular center venturi tube has a fine annular slit formed on the inner peripheral side of the annular body thereof, the annular center venturi tube having a plurality of pores formed inside thereof so as to guide the fuel to the fine annular slit thereof.

5. A carburetor for an internal combustion engine according to claim 1, in which the annular body of the annular center venturi tube is made of a circular annular body.

6. A carburetor for an internal combustion engine according to claim 1, in which an area ratio of the inside air passage to the outside air passage of the annular center venturi tube divided inside the annular venturi tube is set within a range of 25±20%.

7. A carburetor for an internal combustion engine according to claim 1, in which the fuel is supplied to the annular venturi tube from one or more points at a side of the intake pipe.

8. A carburetor for an internal combustion engine according to claim 1, in which the annular center venturi tube is located inside of the intake pipe so as to be shifted from a center of the intake pipe toward the inner wall of the intake pipe in accordance with a shift in location of the annular venturi tube.

9. A carburetor for an internal combustion engine according to claim 1, in which the annular body of the annular center venturi tube has an upstream side and a downstream side, while the upstream side having an inner diameter sharply decreased and the downstream side having an inner diameter gradually increased compared with a diameter change of the upstream side.

10. A carburetor for an internal combustion engine according to claim 1, in which the annular body of the annular center venturi tube has an upstream side and a downstream side, while the upstream side having an outer diameter sharply increased and the downstream side having an outer diameter gradually decreased compared with a diameter change of the upstream side in relation to the fuel discharging portion of the annular venturi tube.

* * * * *